US011148107B2

(12) United States Patent
Hanyu et al.

(10) Patent No.: US 11,148,107 B2
(45) Date of Patent: Oct. 19, 2021

(54) ATOMIZATION DEVICE AND METHOD FOR MANUFACTURING PRODUCT WITH FLUIDITY USING SAID DEVICE

(71) Applicant: MEIJI CO., LTD., Tokyo (JP)

(72) Inventors: Keigo Hanyu, Odawara (JP); Tetsu Kamiya, Odawara (JP); Masashi Onozato, Tokyo (JP)

(73) Assignee: Meiji Co., Ltd., Tokyo (JP)

( * ) Notice: Subject to any disclaimer, the term of this patent is extended or adjusted under 35 U.S.C. 154(b) by 210 days.

(21) Appl. No.: 15/750,324

(22) PCT Filed: Aug. 4, 2016

(86) PCT No.: PCT/JP2016/072896
§ 371 (c)(1),
(2) Date: Feb. 5, 2018

(87) PCT Pub. No.: WO2017/022816
PCT Pub. Date: Feb. 9, 2017

(65) Prior Publication Data

US 2018/0257050 A1 Sep. 13, 2018

(30) Foreign Application Priority Data

Aug. 6, 2015 (JP) ..... JP2015-155890

(51) Int. Cl.
*B01F 7/00* (2006.01)
*B01F 7/16* (2006.01)
(Continued)

(52) U.S. Cl.
CPC ..... *B01F 7/00758* (2013.01); *B01F 3/0807* (2013.01); *B01F 7/164* (2013.01);
(Continued)

(58) Field of Classification Search
CPC ... B01F 7/1635; B01F 7/00758; B01F 3/0807
See application file for complete search history.

(56) References Cited

U.S. PATENT DOCUMENTS 1,353,165 A 9/1920 Johnson
3,532,327 A * 10/1970 Landberg ..... B01F 7/22 366/270
(Continued)

FOREIGN PATENT DOCUMENTS

CN 204122027 U 1/2015
DE 27 02 183 A1 7/1978
(Continued)

OTHER PUBLICATIONS

Supplementary European Search Report, dated Mar. 8, 2019 in the counterpart European Patent Application No. 16 833 095.9.
(Continued)

*Primary Examiner* — Anshu Bhatia
(74) *Attorney, Agent, or Firm* — Wood, Phillips, Katz, Clark & Mortimer

(57) ABSTRACT

An object of the present invention is to develop a mechanism capable of more effectively performing processing such as emulsification, dispersion, dissolution, atomization, mixing, or stirring on a processing object with fluidity using an atomization device including a rotor-stator type mixer while an inside of a processing tank is maintained in a pressured state, at atmospheric pressure, or in a vacuum state, and occurrence of a negative pressure state on a center side (inner diameter side) of a rotor is actively suppressed or prevented.

An atomization device comprises a rotor-stator type mixer in a processing tank. The atomization device performs processing such as emulsification, dispersion, atomization, mixing, or stirring on a processing object with fluidity using the rotor-stator type mixer while an inside of the processing tank
(Continued)

is maintained in a pressured state, at atmospheric pressure, or in a vacuum state. The atomization device has a mechanism in which the rotating rotor makes the processing object flow at a predetermined pressure or higher.

6 Claims, 10 Drawing Sheets

(51) Int. Cl.
*B01F 15/02* (2006.01)
*B01F 3/08* (2006.01)
*B01F 3/12* (2006.01)

(52) U.S. Cl.
CPC ..... *B01F 7/1635* (2013.01); *B01F 15/0239* (2013.01); *B01F 3/08* (2013.01); *B01F 3/12* (2013.01); *B01F 2215/0014* (2013.01); *B01F 2215/0034* (2013.01); *B01F 2215/0036* (2013.01)

(56) References Cited

U.S. PATENT DOCUMENTS

| | | | | |
|---|---|---|---|---|
| 3,785,777 | A | 1/1974 | Porter et al. | |
| 4,738,543 | A | 4/1988 | Seeger | |
| 7,172,337 | B2 * | 2/2007 | Roszczenko ..... | B01F 3/04248 366/270 |
| 2004/0190373 | A1 * | 9/2004 | Golding-Kristensen ..... | B01F 7/164 366/306 |
| 2011/0261643 | A1 * | 10/2011 | Handa ..... | B01F 7/00158 366/270 |
| 2013/0215711 | A1 | 8/2013 | Kamiya | |
| 2015/0306553 | A1 | 10/2015 | Kamiya | |
| 2015/0321154 | A1 | 11/2015 | Enomura | |

FOREIGN PATENT DOCUMENTS

| | | | |
|---|---|---|---|
| EP | 1 541 222 | A1 | 6/2005 |
| GB | 717609 | A | 10/1954 |
| JP | H08-140558 | A | 6/1996 |
| JP | 2001-137680 | A | 5/2001 |
| JP | 2004-530556 | A | 10/2004 |
| JP | 2008-113597 | A | 5/2008 |
| KR | 20110052302 | A | 5/2011 |
| WO | 2012-023218 | A1 | 2/2012 |
| WO | 2012-023609 | A1 | 2/2012 |
| WO | 2014-010094 | A1 | 1/2014 |

OTHER PUBLICATIONS

Revised 6th Edition Chemical Engineering Handbook, The Society of Chemical Engineers, Japan, Maruzen Co., Ltd.
International Preliminary Report on Patentability and Written Opinion, dated Feb. 15, 2018, in PCT/JP2016/072896.
International Search Report, dated Sep. 6, 2016, in PCT/JP2016/072896.
Office Action dated Mar. 15, 2019 in the counterpart Singapore Patent Application No. 11201800144Q.

* cited by examiner

SCHEMATIC DIAGRAM OF MIXER PORTION
(FOR EXPLAINING CALCULATION OF OPENING AREA)

ATOMIZATION DEVICE AND METHOD FOR MANUFACTURING PRODUCT WITH FLUIDITY USING SAID DEVICE

TECHNICAL FIELD

The present invention relates to an atomization device and a method for manufacturing a product with fluidity using the device. Specifically, the present invention relates to an atomization device comprising a rotor-stator type mixer inside a processing tank, and performing any one or more of emulsification processing, dispersion processing, dissolution processing, atomization processing, mixing processing, and stirring processing on a processing object with fluidity using the rotor-stator type mixer while an inside of the processing tank is maintained in a pressured state, at atmospheric pressure, or in a vacuum state. Furthermore, the present invention relates to a method for manufacturing a product with fluidity, including performing any one or more of emulsification processing, dispersion processing, dissolution processing, atomization processing, mixing processing, and stirring processing on a processing object with fluidity using the atomization device.

BACKGROUND ART

Various mechanisms have been proposed for a vacuum mixer that can perform processing such as mixing or stirring on a processing object with fluidity under a condition where an inside of a processing tank (for example, a tank or a mixing unit) has a lower pressure than an external pressure, that is, under a vacuum condition.

Patent Literatures 1 and 2 describe a vacuum mixer having a discharge port of a kneaded product formed at a bottom of a vacuum container and having a bottom opening and closing lid for opening and closing the discharge port of the kneaded product.

Patent Literatures 3 and 4 describe a so-called rotor-stator type mixer as an atomization device capable of performing processing such as emulsification, dispersion, dissolution, atomization, mixing, or stirring on a processing object with fluidity.

Patent Literatures 3 and 4 specifically describe, as the rotor-stator type mixer, a mixer including a stator having a plurality of openings in a peripheral wall thereof, and a rotor disposed inside the stator with a predetermined gap in a radial direction between the rotor and an inner peripheral surface of the stator.

Here, the rotor-stator type mixer is, for example, as illustrated in FIG. 1, a mixer unit 4 constituted by a stator 2 having a plurality of openings 1 in a peripheral wall thereof, and a rotor 3 disposed with a predetermined gap δ in a radial direction between the rotor 3 and an inner peripheral surface of the stator 2.

In such a rotor-stator type mixer, it is possible to utilize a high shearing stress generated in the vicinity of the gap δ having a predetermined size formed in a radial direction between the rotor 3 rotating at high speed and the fixed stator 2, and it is possible to perform processing such as emulsification, dispersion, dissolution, atomization, mixing, or stirring effectively on a processing object with fluidity.

That is, such a rotor-stator type mixer can be widely applied in an application such as mixing or preparing a processing object with fluidity, for example, in a field of a food and drink, a medicinal product, or a chemical product (including a cosmetic product).

CITATION LIST

Patent Literature

Patent Literature 1: JP H08-140558 A
Patent Literature 2: JP 2008-113597 A
Patent Literature 3: WO 2012/023218 A
Patent Literature 4: JP 2004-530556 A

Non-Patent Literature

Non-Patent Literature 1: Revised 6th Edition Chemical Engineering Handbook (edited by The Society of Chemical Engineers, Japan, Maruzen Co., Ltd.)

SUMMARY OF INVENTION

Technical Problem

Patent Literature 3 discloses that an atomization device including a rotor-stator type mixer can be widely applied in an application such as mixing or preparing a processing object with fluidity, for example, in a field of a food and drink, a medicinal product, or a chemical product (including a cosmetic product).

Meanwhile, in a case where processing such as emulsification, dispersion, dissolution, atomization, mixing, or stirring is performed continuously on a processing object with fluidity using an atomization device comprising a rotor-stator type mixer while an inside of a processing tank (for example, a tank or a mixing unit) is maintained in a pressured state, at atmospheric pressure, or in a vacuum state, a negative pressure state occurs on a center side (inner diameter side) of a rotor, and cavitation may thereby occur. Along with this, a problem such as a decrease in power of the atomization device or breakage of the stator occur, and it is difficult to continuously perform the processing for a long time.

Prior art has not proposed a method for actively suppressing or preventing occurrence of a negative pressure state on a center side (inner diameter side) of a rotor when a high shearing type mixer such as a rotor-stator type mixer or a homomixer is used.

Rather, it is said that cavitation occurs due to occurrence of a negative pressure state on a center side (inner diameter side) of a rotor, and that processing such as emulsification, dispersion, dissolution, atomization, mixing, or stirring can be performed effectively.

Under such circumstances, it has been an object to develop a mechanism (configuration) capable of more effectively performing, using an atomization device comprising a rotor-stator type mixer, processing such as emulsification, dispersion, dissolution, atomization, mixing, or stirring on a processing object with fluidity while an inside of a processing tank is maintained in a pressured state, at atmospheric pressure, or in a vacuum state, and occurrence of a negative pressure state on a center side (inner diameter side) of a rotor is actively suppressed or prevented.

Solution to Problem

The present inventor made various studies in order to develop a mechanism capable of more effectively performing, using an atomization device comprising a rotor-stator type mixer, processing such as emulsification, dispersion, dissolution, atomization, mixing, or stirring on a processing object with fluidity while occurrence of a negative pressure state on a center side (inner diameter side) of a rotor is actively suppressed or prevented even in a case where processing such as emulsification, dispersion, dissolution, atomization, mixing, or stirring is continuously performed for a long time on a processing object with fluidity while an inside of a processing tank (a tank, a mixing unit, or the like) is maintained in a pressured state, at atmospheric pressure, or in a vacuum state.

As a result of the studies, the present inventors have found that processing such as emulsification, dispersion, dissolution, atomization, mixing, or stirring can be performed more effectively on a processing object with fluidity by disposing a rotor-stator type mixer inside a processing tank and providing the rotor-stator type mixer with a mechanism in which a rotating rotor makes a processing object with fluidity flow at a predetermined pressure or higher, and have completed the present invention.

That is, the present invention relates to:

[1] An atomization device comprising, inside a processing tank, a rotor-stator type mixer including:

a stator having a plurality of openings in a peripheral wall thereof; and a rotor disposed inside the stator with a predetermined gap in a radial direction between the rotor and an inner peripheral surface of the stator, in which the atomization device performs any one or more of emulsification processing, dispersion processing, dissolution processing, atomization processing, mixing processing, and stirring processing on a processing object with fluidity using the rotor-stator type mixer while an inside of the processing tank is maintained in a pressured state, at atmospheric pressure (normal pressure), or in a vacuum state (reduced pressure), and the atomization has a mechanism in which the rotating rotor makes the processing object flow at a predetermined pressure or higher;

[2] The atomization device according to [1], in which the mechanism in which the rotating rotor makes the processing object flow at a predetermined pressure or higher is a mechanism in which the rotating rotor makes the processing object flow in a direction orthogonal to a rotational direction of the rotor inside the rotor in a radial direction;

[3] The atomization device according to [1] or [2], in which the mechanism in which the rotating rotor makes the processing object flow at a predetermined pressure or higher is a mechanism in which, in the rotating rotor, the rotating rotor makes the processing object flow at a predetermined pressure or higher by disposing an additional rotor in the vicinity of an outer periphery of a rotating shaft for rotating the rotor disposed inside the rotor in a radial direction and rotating the additional rotor;

[4] The atomization device according to any one of [1] to [3], in which the mechanism in which the rotating rotor makes the processing object flow at a predetermined pressure or higher is a mechanism in which, in the rotating rotor, the rotating rotor makes the processing object flow at a predetermined pressure or higher by disposing a draft tube in the vicinity of an outer periphery of a rotating shaft for rotating the rotor disposed inside the rotor in a radial direction;

[5] The atomization device according to any one of [1] to [4], in which the rotor-stator type mixer is a rotor-stator type mixer in which a portion in contact with the processing object in an outer side of the rotor in a radial direction is covered with a lid member;

[6] A method for manufacturing a product with fluidity, comprising performing any one or more of emulsification processing, dispersion processing, dissolution processing, atomization processing, mixing processing, and stirring processing on a processing object with fluidity using the atomization device according to any one of [1] to [5]; and

[7] The method for manufacturing a product with fluidity according to [6], in which the product with fluidity is a food and drink, a medicinal product, or a chemical product.

Advantageous Effects of Invention

The present invention can provide, in an atomization device comprising a rotor-stator type mixer, a new atomization device having a mechanism capable of more effectively performing processing such as emulsification, dispersion, dissolution, atomization, mixing, or stirring on a processing object with fluidity while occurrence of a negative pressure state on a center side (inner diameter side) of a rotor is actively suppressed or prevented even in a case where processing such as emulsification, dispersion, dissolution, atomization, mixing, or stirring is (continuingly) continuously performed for a long time on a processing object with fluidity while an inside of a processing tank (a tank, a mixing unit, or the like) is maintained in a pressured state, at atmospheric pressure, or in a vacuum state.

Furthermore, the present invention can provide a method for manufacturing a product with fluidity (for example, a food and drink, a medicinal product, or a chemical product (including a cosmetic product)), comprising performing processing such as emulsification, dispersion, dissolution, atomization, mixing, or stirring on a processing object with fluidity using such a new atomization device.

BRIEF DESCRIPTION OF DRAWINGS

FIG. 7(*a*) illustrates a screw type rotor, and FIG. 7(*b*) illustrates a propeller type rotor.

DESCRIPTION OF EMBODIMENTS

An atomization device of the present embodiment has a rotor-stator type mixer disposed inside a processing tank (for example, a tank or a mixing unit), and performs any one or more of emulsification processing, dispersion processing, dissolution processing, atomization processing, mixing processing, and stirring processing on a processing object with fluidity using the rotor-stator type mixer while an inside of the processing tank is maintained in a pressured state, at atmospheric pressure (normal pressure), or in a vacuum state (reduced pressure).

Examples of the rotor-stator type mixer include those described in Patent Literatures 3 and 4. Specific examples thereof include a mixer constituted by a stator having a plurality of openings in a peripheral wall thereof, and a rotor disposed inside the stator with a predetermined gap in a radial direction between the rotor and an inner peripheral surface of the stator.

The atomization device of the present embodiment has a mechanism in which the rotating rotor makes the processing object flow at a predetermined pressure or higher.

The mechanism can be in an embodiment that the rotating rotor makes the processing object flow in a direction orthogonal to a rotational direction of the rotor inside the rotor in a radial direction (that is, a direction parallel to an axial direction of a rotating shaft of the rotor). This brings about an embodiment that the rotor makes the processing object flow at a predetermined pressure or higher.

Figure 1:
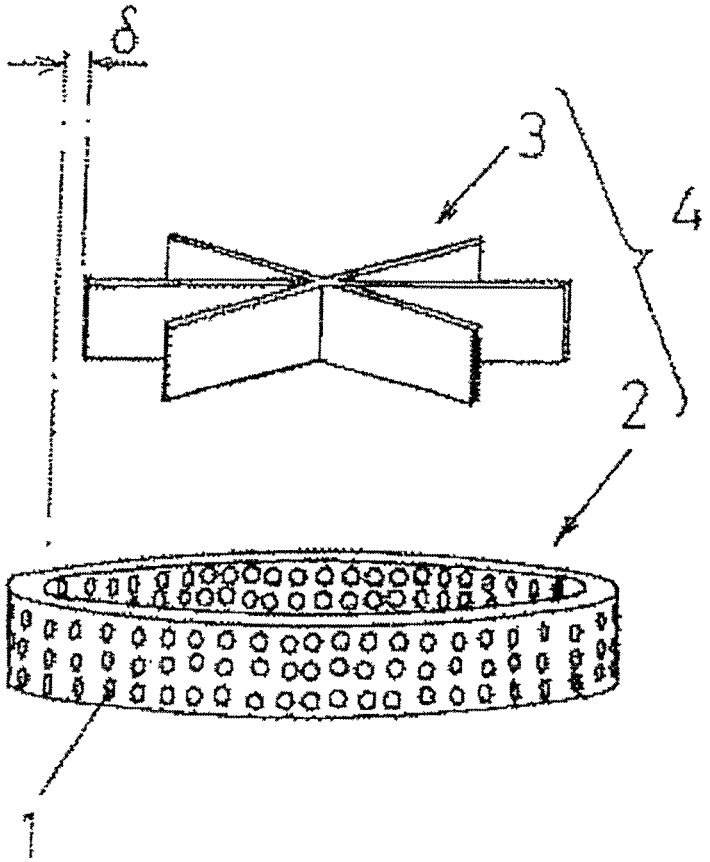
FIG. 1 is a perspective view for explaining a general configuration of a mixer unit included in a rotor-stator type mixer.
Figure 2:
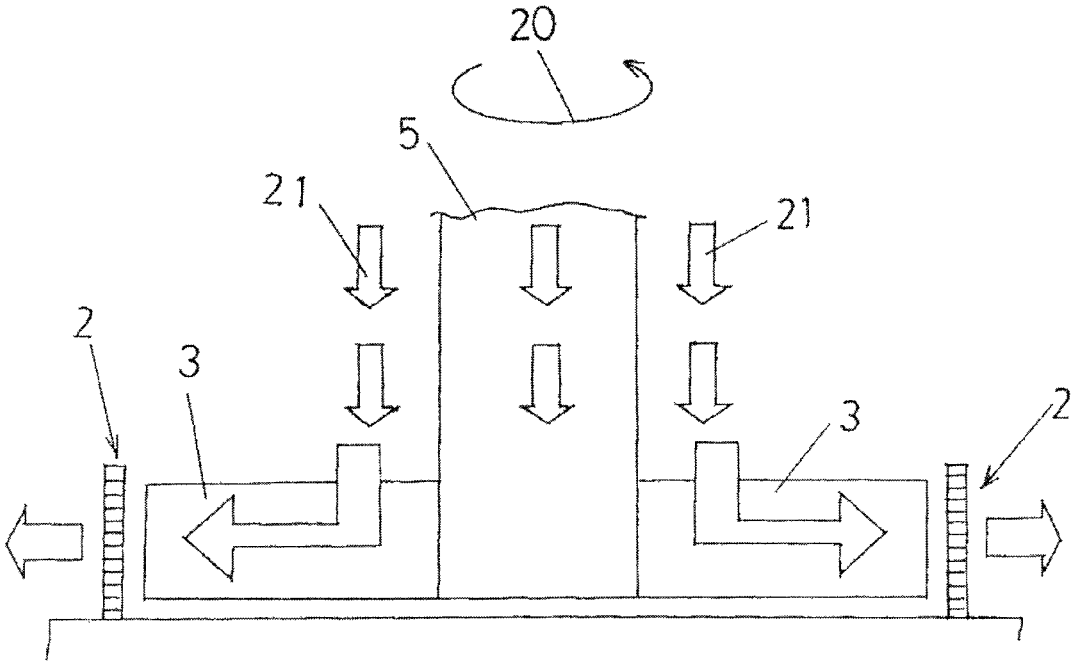
FIG. 2 is a conceptual diagram for explaining a mechanism of a rotor-stator type mixer in an atomization device of the present invention.

Examples thereof include an embodiment having a mechanism in which the rotor 3 rotating around a rotating shaft 5 in the direction indicated by the arrow 20 makes a fluid flow in the direction indicated by the arrow 21, as illustrated in FIG. 2. That is, with such a mechanism, the rotor rotating around the rotating shaft can forcibly make a processing object flow in a direction parallel to the axial direction of the rotating shaft.

Figure 3:
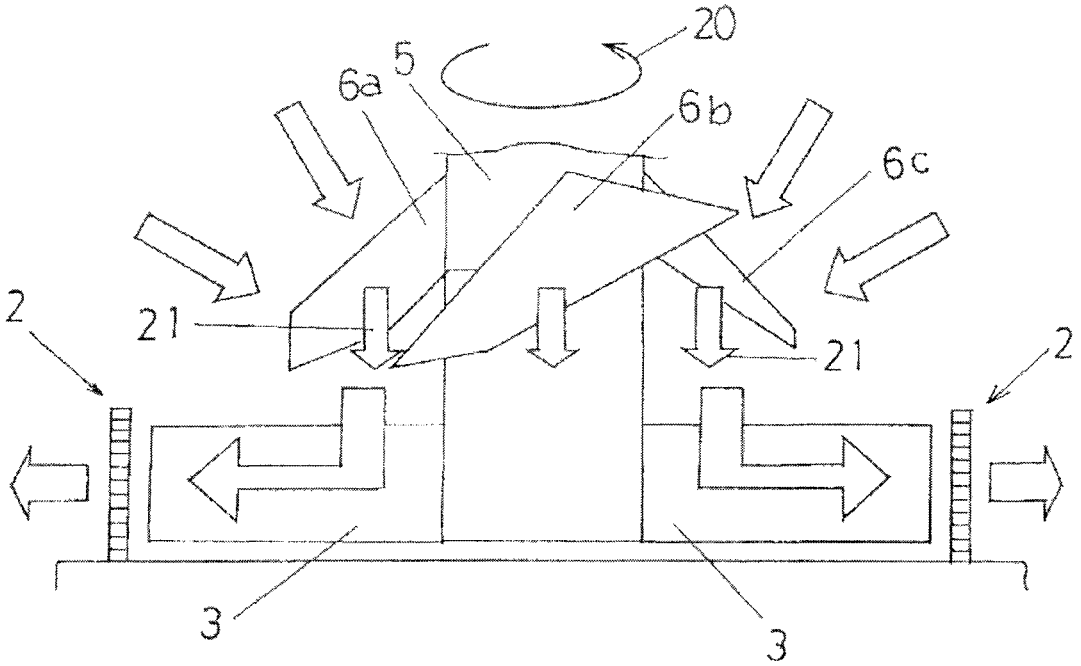
FIG. 3 is a conceptual diagram for explaining an embodiment of the mechanism of the rotor-stator type mixer in the atomization device of the present invention.

An embodiment of a mechanism for making a processing object flow is illustrated in FIG. 3, for example.

In the embodiment illustrated in FIG. 3, the mechanism is in an embodiment that, in the rotating rotor, the rotating rotor makes the processing object flow at a predetermined pressure or higher by disposing an additional rotor in the vicinity of an outer periphery of the rotating shaft 5 for rotating the rotor disposed inside the rotor in a radial direction and rotating the additional rotor.

Examples thereof include an embodiment that additional rotors (second rotors) 6*a*, 6*b*, and 6*c* are fixed to the rotating shaft 5 at an upper portion of the rotor 3, as illustrated in FIG. 3. Note that, hereinafter, the second rotors 6*a*, 6*b*, and 6*c* may be collectively referred to as a "second rotor 6".

That is, as illustrated in FIG. 3, due to rotation of the rotating shaft 5, the rotor 3 fixed to the rotating shaft 5 rotates in the direction indicated by the arrow 20, and simultaneously the second rotor 6 also rotates in the direction indicated by the arrow 20. This makes a processing object forcibly flow in the direction indicated by the arrow 21 (in a direction parallel to the axial direction of the rotating shaft 5, for example, in a substantially parallel direction). In this way, the embodiment has a mechanism in which the rotating rotor 3 makes a processing object flow at a predetermined pressure or higher by feeding the processing object in a direction of the rotor 3 rotating in the direction indicated by the arrow 20.

Note that, as illustrated in FIG. 3, one additional rotor (second rotor) (one set of additional rotors) or two or more additional rotors may be disposed. One additional rotor is preferably disposed from a viewpoint of simplifying the mechanism of the atomization device of the present embodiment and improving easiness of washing or the like of the atomization device.

For example, another embodiment of the mechanism for making a processing object flow is a mechanism in which, in the rotating rotor, the rotating rotor makes the processing object flow at a predetermined pressure or higher by disposing a draft tube in the vicinity of an outer periphery of a rotating shaft for rotating the rotor disposed inside the rotor in a radial direction. That is, even with such a mechanism, the rotor rotating around the rotating shaft can forcibly make a processing object flow in a direction parallel to the axial direction of the rotating shaft, for example, in a substantially parallel direction.

Here, although not illustrated, for example, a draft tube is disposed in the vicinity of an outer periphery of the rotating shaft 5, and this makes a processing object forcibly flow in the direction indicated by the arrow 21. In this way, the embodiment has a mechanism in which the rotating rotor 3 makes a processing object flow at a predetermined pressure or higher by feeding the processing object in a direction of the rotor 3 rotating in the direction indicated by the arrow 20.

Although not illustrated, as illustrated in FIG. 3, the second rotor 6 is disposed as an additional rotor, and a draft tube is further disposed in the vicinity of an outer periphery of the rotating shaft 5. This makes it possible to obtain a mechanism for forcibly making a processing object flow in the direction indicated by the arrow 21.

Note that one draft tube (one set of draft tubes) or two or more draft tubes may be disposed. One draft tube is preferably disposed from a viewpoint of simplifying the mechanism of the atomization device of the present embodiment and improving detergency or the like of the atomization device.

In any case, in FIGS. 2 and 3, by forcibly making a processing object flow in the direction indicated by the arrow 21, even in a case where processing such as emulsification, dispersion, atomization, mixing, or stirring is continuously performed for a long time on a processing object with fluidity while an inside of a processing tank is maintained in a pressured state, at atmospheric pressure, or in a vacuum state, occurrence of a negative pressure state on a center side (inner diameter side) of the rotor 3 can be actively suppressed or prevented. This makes it possible to suppress or prevent occurrence of cavitation.

In the atomization device of the present embodiment illustrated in FIGS. 2 and 3 described above and having the mechanism described above, the phrase "the rotating rotor 3 makes a processing object flow at a predetermined pressure or higher" means that the processing object is made to flow, for example, in a case where processing such as emulsification, dispersion, dissolution, atomization, mixing, or stirring is performed in a processing tank having a capacity of 20000 L, specifically, at an absolute pressure of 101300 (normal pressure) Pa or more or at a pressure equal to or higher than a vapor pressure.

Figure 5:
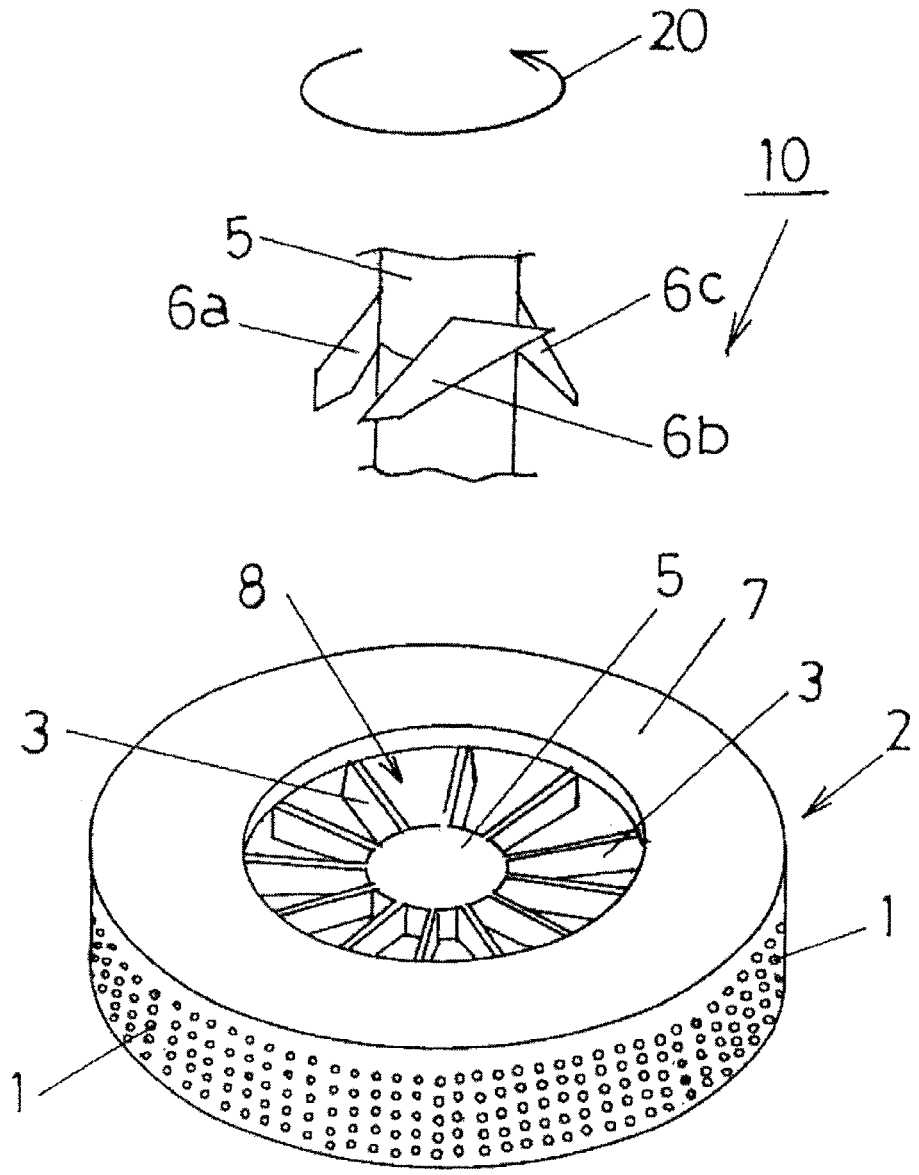
FIG. 5 is a perspective view for explaining another embodiment of the mechanism of the rotor-stator type mixer in the atomization device of the present invention.

In the embodiment illustrated in FIG. 3 or 5, in a case where the rotating rotor 3 makes a processing object flow at a predetermined pressure or more using the second rotor 6, it is preferable to adopt a structure capable of actively making the processing object flow at a predetermined pressure or higher with regard to the angle of the second rotor 6, the shape/structure (size and inclination) of a stirring blade, and the like.

Here, the angle of the second rotor 6 is an angle at which a stirring blade is inclined with respect to a plane orthogonal to a direction of a rotating shaft. For example, in the upper second rotor illustrated in FIG. 10, the angle of the second rotor, that is, the inclination of a stirring blade is 32 degrees, and in the lower second rotor illustrated in FIG. 10, the angle of the second rotor, that is, the inclination of a stirring blade is 25 degrees.

In a conventional atomization device including a conventional rotor-stator type mixer in a processing tank, by performing processing such as emulsification, dispersion, dissolution, atomization, mixing, or stirring continuously for a long time on a processing object with fluidity while an inside of the processing tank is maintained in a pressured state, at atmospheric pressure, or in a vacuum state, cavitation occurs. This leads to a decrease in power, and reduces efficiency of processing.

Meanwhile, the atomization device including the rotor-stator type mixer of the present embodiment has the mechanism in which a rotating rotor makes a processing object flow at a predetermined pressure or higher, illustrated in FIGS. 2 and 3 and described above.

According to such an atomization device of the present embodiment, even in a case where processing such as emulsification, dispersion, dissolution, atomization, mixing, or stirring is continuously performed for a long time on a processing object with fluidity while an inside of a processing tank is maintained in a pressured state, at atmospheric pressure, or in a vacuum state, occurrence of a negative pressure state on a center side (inner diameter side) of a rotor can be actively suppressed or prevented. This suppresses a decrease in power, and makes it possible to more effectively perform processing such as emulsification, dispersion, dissolution, atomization, mixing, or stirring on a processing object with fluidity.

The term "vacuum state" used herein means an air pressure lower than the atmospheric pressure state, and is preferably 0 to −0.5 MPa, more preferably 0 to −0.2 MPa, still more preferably 0 to −0.15 MPa, and particularly preferably 0 to −0.1 MPa.

In a conventional atomization device including a conventional rotor-stator type mixer, by performing processing such as emulsification, dispersion, dissolution, atomization, mixing, or stirring continuously for a long time on a processing object with fluidity while an inside of a processing tank is maintained in a pressured state, at atmospheric pressure, or in a vacuum state, for example, a stator is broken disadvantageously due to occurrence of cavitation.

Meanwhile, the atomization device including the rotor-stator type mixer of the present embodiment has the mechanism in which a rotating rotor makes a processing object flow at a predetermined pressure or higher, illustrated in FIGS. 2 and 3 and described above. According to such an atomization device of the present embodiment, even in a case where processing such as emulsification, dispersion, dissolution, atomization, mixing, or stirring is continuously performed for a long time on a processing object with fluidity while an inside of a processing tank is maintained in a pressured state, at atmospheric pressure, or in a vacuum state, a problem such as breakage of a stator due to occurrence of cavitation can be solved.

In the atomization device of the present embodiment, a portion in contact with the processing object in an outer side of the rotor in a radial direction may be covered with a lid member.

Figure 4:
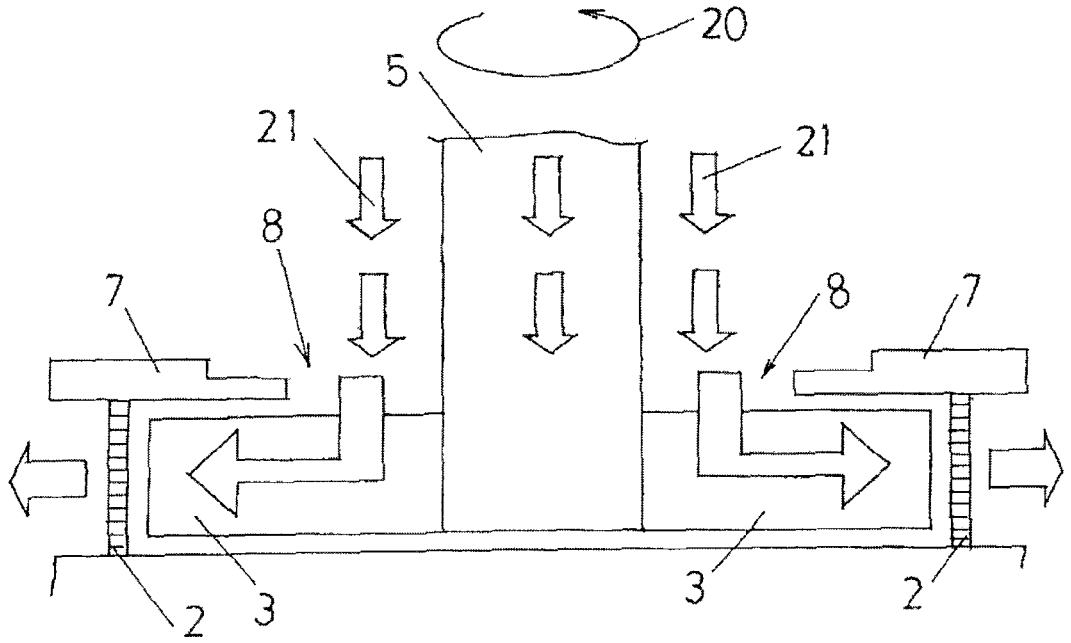
FIG. 4 is another conceptual diagram for explaining the mechanism of the rotor-stator type mixer in the atomization device of the present invention.

In the embodiment illustrated in FIGS. 4 and 5, a lid member 7 having an opening 8 inside thereof in a radial direction covers a part of the upper stator 2 from an outer side in a radial direction.

That is, in the rotor-stator type mixer illustrated in FIGS. 4 and 5, a portion (upper portion) where a processing object should be made to flow freely toward an outside in a radial direction is covered with the lid member 7 having a doughnut shape (double circular shape) or the like, and is closed Therefore, in the embodiment illustrated in FIGS. 4 and 5, when the processing object is made to flow in the direction indicated by the arrow 21 by the mechanism in which the rotating rotor 3 makes the processing object flow at a predetermined pressure or higher, the rotor 3 rotating in the direction indicated by the arrow 20 makes the processing object flow in the direction of the rotor 3 via the opening 8 formed on an inner diameter side of the lid member 7. This suppresses or prevents occurrence of a negative pressure state on a center side (inner diameter side) of the rotor 3 more actively, and occurrence of cavitation can be thereby suppressed or prevented more effectively.

In the embodiment illustrated in FIGS. 4 and 5, by the mechanism in which the rotating rotor 3 makes a processing object flow at a predetermined pressure or higher, when the processing object is made to flow from the direction indicated by the arrow 21 toward the rotor 3, in the vicinity of an inner periphery of the stator 2, the lid member 7 covers and closes a portion (upper portion) where the processing object should be made to flow freely toward an outside in a radial direction, and therefore a state in which the processing object does not pass through the stator 2 but leaks from the vicinity of the rotor 3 to an outside hardly occurs. This suppresses or prevents occurrence of a negative pressure state on a center side (inner diameter side) of the rotor 3 more actively, and occurrence of cavitation can be thereby suppressed or prevented more effectively.

For example, by adopting the embodiment illustrated in FIGS. 4 and 5, in the vicinity of the gap $\delta$ having a predetermined size, formed between the rotor 3 rotating at high speed and the fixed stator 2 in a radial direction, generation of a high shearing stress can be utilized. This makes it possible to more effectively perform processing such as emulsification, dispersion, dissolution, atomization, mixing, or stirring on a processing object with fluidity.

Related art has not proposed a method for actively suppressing or preventing occurrence of a negative pressure state on a center side (inner diameter side) of a rotor when a high shearing type mixer such as a rotor-stator type mixer or a homomixer is used. Rather, it has been said that cavitation occurs due to occurrence of a negative pressure state on a center side (inner diameter side) of a rotor, and that processing such as emulsification, dispersion, dissolution, atomization, mixing, or stirring can be performed effectively.

Unlike the atomization device of the present embodiment, related art has not made studies for disposing a member corresponding to the second rotor in order to actively suppress or prevent occurrence of a negative pressure state on a center side (inner diameter side) of the rotor 3. In addition, the shape/structure (size and inclination) of a stirring blade, or the like required for the second rotor has not been studied such that the rotating rotor 3 makes a processing object flow at a predetermined pressure or higher.

Here, in the atomization device of the present embodiment, the shape/structure of the second rotor 6 is not particularly limited as long as being able to exert a force to make a processing fluid flow so as to push the processing fluid toward the rotor 3 and the stator 2. However, a screw type or a propeller type is preferable, and a propeller type is more preferable from a viewpoint of being able to strongly exert a force to make the processing fluid flow so as to push the processing fluid.

In the atomization device of the present embodiment, for example, in a case where the length (diameter) of the rotor 3 in a radial direction around the rotating shaft 5 is 250 to 500 mm, the height of a stirring blade of the second rotor 6 (length of the rotating shaft 5 in an axial direction) is preferably 80 mm or more. The height is more preferably 100 mm or more, still more preferably 120 mm or more, still more preferably 140 mm or more, still more preferably 160 mm or more, still more preferably 180 mm or more, still more preferably 200 mm or more, still more preferably 220 mm or more, still more preferably 240 mm or more, still more preferably 260 mm or more, and still more preferably 280 mm or more.

Note that an upper omit of the height of a stirring blade of the second rotor 6 is not particularly limited as long as being within the length of the rotating shaft 5 in an axial direction. However, for example, the height of the stirring blade of the second rotor 6 is preferably 1500 mm or less. The height is more preferably 1000 mm or less, still more preferably 800 mm or less, and still more preferably 600 mm or less.

In the atomization device of the present embodiment, for example, in a case where the length (diameter) of the rotor 3 in a radial direction around the rotating shaft 5 is 250 to 500 mm, the inclination of a stirring blade of the second rotor 6 is preferably 10 to 80°, more preferably 15 to 70°, still more preferably 20 to 60°, still more preferably 25 to 50°, still more preferably 25 to 40°, still more preferably 30 to 40°, and still more preferably 30 to 35°.

If the inclination of the stirring blade of the second rotor 6 is 10 to 80°, the rotating rotor 3 can effectively make a processing object flow at a predetermined pressure or higher in order to actively suppress or prevent occurrence of a negative pressure state on a center side (inner diameter side) of the rotor 3.

In the atomization device of the present embodiment, as compared with a conventional atomization device including a conventional rotor-stator type mixer, even in a case where processing such as emulsification, dispersion, dissolution, atomization, mixing, or stirring is continuously performed for a long time on a processing object with fluidity while an inside of a processing tank is maintained in a pressured state, at atmospheric pressure, or in a vacuum state, occurrence of a negative pressure state on a center side (inner diameter side) of the rotor 3 can be actively suppressed or prevented. This suppresses a decrease in power, and makes it possible to more effectively perform processing such as emulsification, dispersion, dissolution, atomization, mixing, or stirring on a processing object with fluidity.

Furthermore, in the atomization device of the present embodiment, as compared with a conventional atomization device including a conventional rotor-stator type mixer, even in a case where processing such as emulsification, dispersion, dissolution, atomization, mixing, or stirring is continuously performed for a long time on a processing object with fluidity while an inside of a processing tank is maintained in a pressured state, at atmospheric pressure, or in a vacuum state, occurrence of a negative pressure state on a center side (inner diameter side) of the rotor 3 can be actively suppressed or prevented. This suppresses or prevents occurrence of cavitation more effectively, and a problem such as breakage of a stator due to occurrence of cavitation can be solved.

Figure 6:
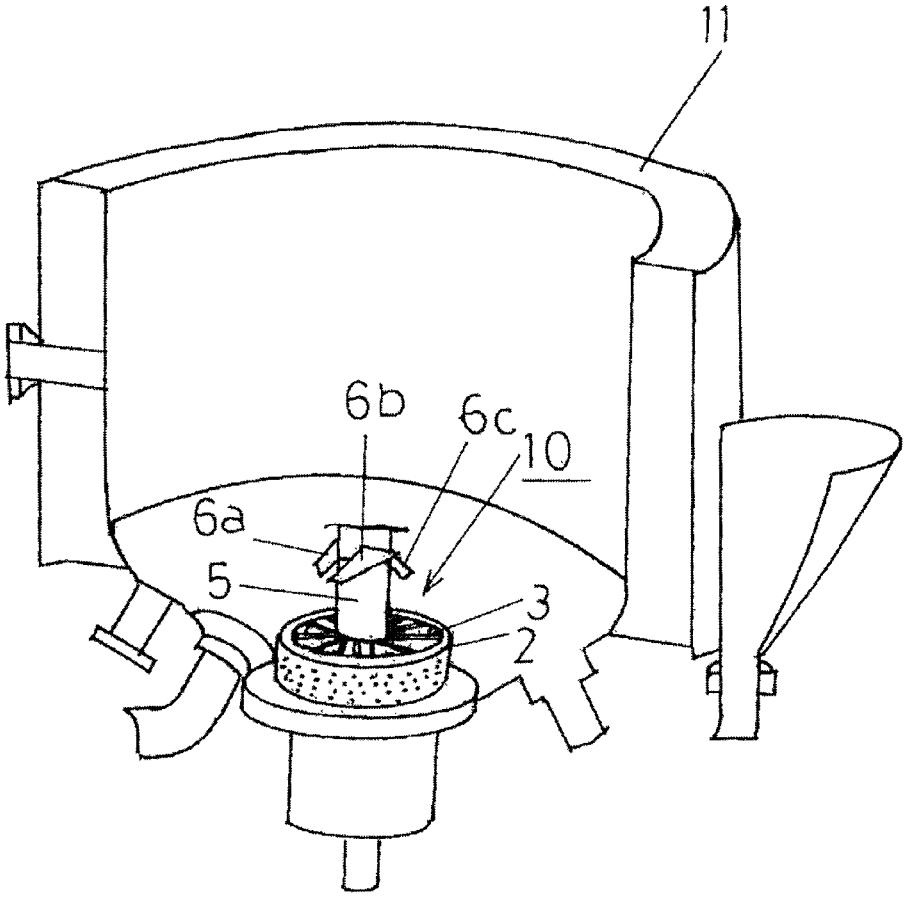
FIG. 6 is a conceptual diagram for explaining an embodiment of the atomization device of the present invention, and a perspective view obtained by omitting and cutting a part thereof.

In the atomization device of the present embodiment, as illustrated in FIG. 6 which is an exploded perspective view with a part omitted, it is possible to dispose a mechanism in which the rotating rotor 3 makes a processing object flow at a predetermined pressure or higher in a processing tank 11 an inside of which can be maintained in a pressured state, at atmospheric pressure, or in a vacuum state, as illustrated in FIG. 5 (reference sign 10).

In the atomization device of the present embodiment, as compared with a conventional atomization device including a conventional rotor-stator type mixer, it is possible to perform processing such as emulsification, dispersion, dissolution, atomization, mixing, or stirring continuously performed for a long time in a state where processing ability is high.

When processing such as emulsification, dispersion, dissolution, atomization, mixing, or stirring is performed on a processing object with fluidity using the atomization device of the present embodiment, it is possible to efficiently perform processing such as emulsification, dispersion, dissolution, atomization, mixing, or stirring on solid (powder or the like) and liquid (water or the like) in a state where processing ability is high.

At this time, for example, using the atomization device of the present embodiment, time required for dispersing or dissolving a predetermined amount of solid (powder or the like) in a processing object with fluidity (water or the like) in a state where processing ability is high can be shorter than before.

Furthermore, using the atomization device of the present embodiment, time required for dispersing or dissolving a large amount of solid (powder or the like) in a processing object with fluidity (water or the like) in a state where processing ability is high can be set within a predetermined range.

Note that the term "solid" used herein means all solids which can be emulsified, dispersed, dissolved, atomized, mixed, stirred, or the like in a processing object with fluidity, such as powder.

When processing such as emulsification, dispersion, dissolution, atomization, mixing, or stirring is performed on a processing object with fluidity using the atomization device of the present embodiment, it is possible to efficiently perform the processing such as emulsification, dispersion, dissolution; atomization, mixing, or stirring on any aqueous phase and oil phase in a state where processing ability is high. This makes it possible to manufacture both an oil-in-water type emulsion and a water-in-oil type emulsion.

When processing such as emulsification, dispersion, dissolution, atomization, mixing, or stirring is performed on a processing object with fluidity using the atomization device of the present embodiment, it is possible to adjust and set conditions for processing such as emulsification, dispersion, dissolution, atomization, mixing, or stirring according to a concept similar to that of the atomization device described in Patent Literature 3 (WO 2012/023218 A).

Specifically, the conditions can be adjusted and set by the following formula 1.

[Numerical formula 1]

$$\varepsilon_t = \varepsilon_\ell f_{s,h} t_m \quad \text{Formula 1}$$
$$= \left[A\pi^4 n_r (D+2\delta) D^3 h \left(\frac{4\ell}{d}+1\right)\left(\frac{N_p}{N_{qd}\pi^2}-1\right)\right]\left(\frac{N^4}{V} t_m\right)$$
$$= C_h\left(\frac{N^4}{V} t_m\right)$$

Here, in the above formula 1, $\varepsilon_t$: Total energy dissipation ratio [$m^2/s^3$]

$\varepsilon_l$: Local energy dissipation ratio in opening of stator [$m^2/s^3$]

$f_{s,h}$: Shearing frequency $t_m$: Mixing time [s]

A: Opening ratio of stator [−]

$n_r$: Number of rotor blades [−]

D: Diameter of rotor [m]

δ: Gap between rotor and stator [m]

h: Height of stator [m]

l: Thickness of stator [m]

d: Hole diameter of stator [m]

$N_p$: Power number [−]

$N_{qd}$: Flow rate number [−]

N: Rotation number [1/s]

V: Liquid amount [$m^3$]

$C_h$: Shape dependent term in stator [$m^5$]

In the above formula 1, the local energy dissipation ratio of an opening of a stator (that is, local energy dissipation ratio in a gap between a rotor and the stator): $\varepsilon_l$ [$m^2/s^3$] corresponds to "emulsification strength (how the force is strong)". In addition, the shearing frequency: $F_{s\ h}$ indicates how many times the force has been received per unit time.

Therefore, the total energy dissipation ratio: $\varepsilon_t$ is determined by a product of "emulsification strength (how the force is strong)", "shearing frequency (how many times the force has been received per unit time)", and "mixing time: $t_m$ [s]".

"Opening Ratio of Stator: A [−]" in the Above Formula 1

Figure 13:
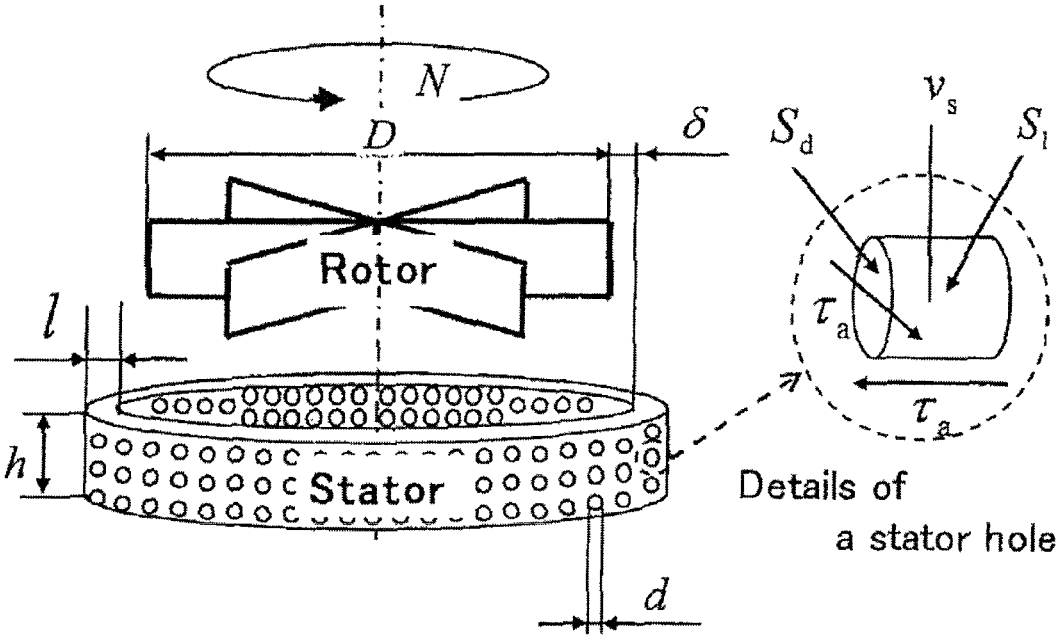
FIG. 13 is a reference diagram for explaining calculation of an opening ratio of a stator.

FIG. 13 is a reference diagram for explaining calculation of the opening ratio of a stator: A [−]. The opening ratio of a stator: A [−] is a ratio Sh/Ss [−] between the area of a stator side surface: Ss [$m^2$] and the area of all the holes: Sh [$m^2$].

$Ss=\pi*(D+2\delta)*h$ and $Sh=\pi/4*d^2*n$ are satisfied, and therefore the opening ratio of a stator: A [−] can be calculated by $A=d^2*n/(4*(D+2\delta)*h)$. Here, D represents a blade diameter [m], h represents the height [m] of a stator, d represents a hole diameter [m], and n represents the number of holes [−].

"Power Number: Np [−]" in the Above Formula 1

"Table 7·1 Dimensionless number often used for stirring" on page of "7 Stirring" in Non-Patent Literature 1 (Revised 6th Edition Chemical Engineering Handbook (edited by The Society of Chemical Engineers, Japan, Maruzen Co., Ltd.)) describes that the power number can be determined by a calculation formula of $Np=P/\rho*N^3*D^5$. Here, P represents power [kW], ρ represents density [$kg/m^3$], N represents a rotation number [$s^{-1}$], and D represents a blade diameter [m] (in Table 7·1 in Non-Patent Literature 1 "Chemical Engineering Handbook", the rotation number is represented by n (small letter) and the blade diameter is represented by d (small letter). However, here, the rotation number is represented by N (capital letter) and the blade diameter is represented by D (capital letter) in order to unify the signs in the present specification).

The power is known as an actual measurement value. The density, the rotation number, and the blade diameter are known as physical property values and operation conditions. Therefore, the power number: Np can be calculated as a numerical value.

"Flow Rate Number: Nqd" in the Above Formula 1

Similarly to the power number: Np, as described in "Table 7·1 Dimensionless number often used for stirring" on page of "7 Stirring" in Non-Patent Literature 1 (Revised 6th Edition Chemical Engineering Handbook (edited by The Society of Chemical Engineers, Japan, Maruzen Co., Ltd.)), the (discharge) flow rate number can be determined by a calculation formula of $Nqd=qd/N*D^3$. Here, qd represents a discharge flow rate [$m^3/s$], N represents a rotation number [$s^{-1}$], and D represents a blade diameter [m].

The discharge flow rate is known as an actual measurement value, the rotation number and the blade diameter are known as device conditions and operation conditions, and the flow rate number: Nqd can be calculated as a numerical value.

Relationship Between the Above Formula 1 and "Droplet Diameter"

As verified in Patent Literature 3 (WO 2012/23218 A), in a rotor-stator type mixer, a change in droplet diameter of a processing fluid (atomization tendency of droplet) can be collectively expressed (evaluated) by the total energy dissipation ratio: $\varepsilon_t$ determined by the above formula 1.

By evaluating the magnitude of a value of the shape dependent term in a stator: $C_h$ [−] which is a numerical value specific to each mixer, obtained by measuring the size of a rotor-stator and the power/flow rate during operation, included in the calculation formula for deriving the total energy dissipation ratio: $\varepsilon_t$, it is possible to evaluate performance of a mixer (performance of a mixer in processing such as emulsification, dispersion, dissolution, atomization, mixing, or stirring on a processing fluid).

As clear from the above calculation formula for deriving the total energy dissipation ratio: $\varepsilon_t$, the shape dependent term in a stator: $C_h$ [−] is specific to each mixer based on the opening ratio of a stator: A [−], the number of rotor blades: $n_r$ [−], the diameter of a rotor: D [m], the gap between a rotor and a stator: δ [m], the height of a stator: h [m], the hole diameter in a stator: d [m], the thickness of a stator: l [m], the flow rate number: $N_{qd}$ [−], and the power number: $N_p$ [−].

Therefore, by comparing (evaluating) the magnitude of this value, it is possible to evaluate performance of various kinds of mixers (performance of mixers in processing such as emulsification, dispersion, dissolution, atomization, mixing, or stirring on a processing fluid).

By comparing (evaluating) the magnitude of a value of the shape dependent term in a stator: $C_h$ [−] in the above formula 1 for deriving the total energy dissipation ratio: $\varepsilon_t$, it is possible to evaluate performance of various kinds of mixers.

Therefore, by comparing (evaluating) the magnitude of a value of the shape dependent term in a stator: $C_h$ [−] which is a numerical value specific to each mixer included in the above formula 1 for deriving the total energy dissipation ratio: $\varepsilon_t$, it is possible to evaluate performance of various kinds of mixers and to design (develop and manufacture) a high performance mixer.

As verified in Patent Literature 3 (WO 2012/23218 A), the total energy dissipation ratio: $\varepsilon_t$ calculated by the above formula 1 is an index for making it possible to evaluate performance of a rotor-stator type mixer by considering a difference in operation conditions and shape comprehensively.

In a rotor-stator type mixer, by performing matching of a value of the total energy dissipation ratio: $\varepsilon_t$, it is possible to scale up or scale down the rotor-stator type mixer by considering a difference in operation conditions and shape comprehensively.

Furthermore, by matching a value of the total energy dissipation ratio: $\varepsilon_t$ of a rotor-stator type mixer in an experimental scale or in a pilot plant scale with a calculation value of $\varepsilon_t$ of an actual manufacturing machine to be scaled up or scaled down, the machine can be scaled up or scaled down.

That is, as verified in Patent Literature 3, in a case where a processing fluid is processed using a rotor-stator type mixer, if the total energy dissipation ratio $\varepsilon_t$ determined by the above formula 1 is large, it is known that the droplet diameter tends to be small. The following relational formula is satisfied between an average droplet diameter: $d_{50}$ of a processing fluid after actual processing and the total energy dissipation ratio: $\varepsilon_t$ determined by the above formula 1.

Average droplet diameter: $d_{50}=a*Ln(\varepsilon_t)+b(R=0.91, a=-6.2465, b=116.42)$ When a processing fluid is processed using a rotor-stator type mixer, the total energy dissipation ratio: $\varepsilon_t$ calculated from the above formula 1 necessary for obtaining a predetermined droplet diameter can be obtained from the above relational formula.

Next, when information (N: rotation number, $t_m$: mixing time, V: volume of processing liquid, . . . , single manufacturing amount) relating to operation conditions of the above formula 1 is input, a value of the shape dependent term: $C_h$ necessary for obtaining a predetermined droplet diameter can be calculated backward at a predetermined liquid amount within a predetermined time at a predetermined rotation number. Finally, the shape of a mixer is calculated so as to obtain a predetermined value of the shape dependent term: $C_h$.

In this way, when information on the shape of a mixer is input, the shape dependent term: $C_h$ can be calculated. As a result, by determining a predetermined droplet diameter and inputting predetermined manufacturing conditions, it is possible to calculate information on the most suitable shape of the mixer, and it is possible to design the mixer according to this guideline.

Meanwhile, in order to estimate atomization performance of an actually designed mixer, the calculation procedure described above is performed backward. Specifically, when information on the shape of the actually designed mixer is input, the shape dependent term: $C_h$ can be calculated.

Next, by inputting the shape dependent term: $C_h$ and predetermined operation conditions (N: rotation number, $t_m$: mixing time, V: volume of processing liquid, . . . , single manufacturing amount), a value of the above formula 1 (total energy dissipation ratio: $\varepsilon_t$) can be calculated.

Finally, by substituting the value calculated from the above formula 1 in the above relational formula between the average droplet diameter $d_{50}$ and the total energy dissipation ratio: $\varepsilon_t$, it is possible to calculate a droplet diameter obtained at a predetermined liquid amount within a predetermined time at a predetermined rotation number.

As indicated in the above relational formula between the average droplet diameter: $d_{50}$ and the total energy dissipation ratio: $\varepsilon_t$, when the total energy dissipation ratio $\varepsilon_t$ is large, the droplet diameter tends to be small.

The above formula 1 is established by the shape dependent term: $C_h$ and operation condition terms (N: rotation number, $t_m$: mixing time, V: volume of processing liquid, . . . , single manufacturing amount).

Usually, it is considered that the operation condition terms are determined under various assumptions and are not easily changed. The operation condition terms can be assumed as a constant value.

Therefore, as the shape dependent term increases, the droplet diameter decreases. That is, it can be said that the droplet diameter is a function of the shape dependent term.

Therefore, by evaluating the magnitude of the shape dependent term, it is possible to numerically evaluate performance of a mixer (that is, performance of processing such as emulsification, dispersion, dissolution, atomization, mixing, or stirring).

Therefore, by calculating the total energy dissipation ratio: $\varepsilon_t$ [$m^2/s^3$] based on the above formula 1, operation time of the atomization device of the present embodiment including a rotor-stator type mixer for performing processing such as emulsification, dispersion, dissolution, atomization, mixing, or stirring on a processing object with fluidity, and a droplet diameter of a product obtained by the operation are estimated. A product with fluidity having a desired droplet diameter can be manufactured.

Also in the rotor-stator type mixer included in the atomization device of the present embodiment, a relational formula between a droplet diameter and a value (magnitude) of the total energy dissipation ratio: $\varepsilon_t$ is established according to a concept similar to that of the atomization device described in Patent Literature 3, and a value of the total energy dissipation ratio: $\varepsilon_t$ required for a desired droplet diameter can be calculated based on the relational formula. Here, as described above, the droplet diameter depends on a value of the total energy dissipation ratio: $\varepsilon_t$, and there is a relational formula that the value of the total energy dissipation ratio: $\varepsilon_t$ increases as the droplet diameter decreases.

For example, for a specific processing object with fluidity, a logarithmic relationship between a droplet diameter and the total energy dissipation ratio: $\varepsilon_t$ is calculated at two or more points in a small scale (lab scale or pilot scale) using a rotor-stator type small mixer. Then, these relationships are formulated by a linear least squares method, a nonlinear least squares method, or the like, and a value of the total energy dissipation ratio: $\varepsilon_t$ corresponding to a target droplet diameter can be calculated.

Note that, when a value of the total energy dissipation ratio: $\varepsilon_t$ is calculated, a logarithmic relationship between a droplet diameter and the total energy dissipation ratio: $\varepsilon_t$ can be calculated at two or more points using a mixer used for actual processing in an actual processing scale, for example.

The rotor-stator type mixer included in the atomization device of the present embodiment has a mechanism in which a rotating rotor makes a processing object with fluidity flow at a predetermined pressure or higher. Therefore, as compared with a conventional atomization device including a conventional rotor-stator type mixer, the power number: $N_p$ [−] and a coefficient of the shape dependent term in a stator: $C_h$ can be increased.

Note that the power number: Np [−] is defined as described above, and is a dimensionless number generally used in the field of chemical engineering. In other words, the power number: Np [−] is a dimensionless number that can be derived from power: P measured by an experiment. Note that the power: P is synonymous with power consumption [Kw] of a rotor-stator type mixer.

In a conventional atomization device including a conventional rotor-stator type mixer, the coefficient of the shape dependent term in a stator: $C_h$ is constant. Therefore, if it is intended to reduce a droplet diameter, it is necessary to increase a value of the total energy dissipation ratio: $\varepsilon_t$. For this purpose, it is necessary to increase the mixing time: $t_m$ [s] and the rotation number: N [$s^{-1}$] and to decrease the liquid amount: V [$m^3$].

Meanwhile, in the atomization device of the present embodiment, even in the atomization device including a rotor-stator type mixer, the coefficient of the shape dependent term in a stator: $C_h$ itself can be increased. Therefore, with the mixing time: $t_m$ [s], the rotation number: N [$s^{-1}$], and the liquid amount: V [$m^3$] similar to those of the conventional device, the droplet diameter can be smaller.

Furthermore, in the atomization device of the present embodiment, even in the atomization device including a rotor-stator type mixer, the coefficient of the shape dependent term in a stator: $C_h$ itself can be increased. Therefore, with the rotation number: N [$s^{-1}$] and the liquid amount: V [$m^3$] similar to those of the conventional device, the required mixing time: $t_m$ [s] can be shorter.

These are realized because the rotor-stator type mixer included in the atomization device of the present embodiment has a mechanism in which a rotating rotor makes a processing object flow at a predetermined pressure or higher.

Generally, in an atomization device including a conventional rotor-stator type mixer, in a case where processing ability is improved, parts of the device are damaged early due to deterioration of the device itself, and it is necessary to repair or exchange parts of the device with high frequency. Even by using the atomization device of the present embodiment, it is expected that it will be necessary to repair or exchange parts of the device similarly to the conventional device.

However, contrary to such expectation, in the atomization device of the present embodiment, even in a case where processing ability is continuously improved for a long time particularly while an inside of a processing tank is maintained in a vacuum state, a problem of breakage of a stator due to occurrence of cavitation is solved, and it is unnecessary to repair or exchange parts of the device with high frequency.

Particularly, in a case where processing such as emulsification, dispersion, dissolution, atomization, mixing, or stirring is performed continuously for a long time on a processing object with fluidity using a conventional atomization device including a conventional rotor-stator type mixer while an inside of a processing tank is maintained in a vacuum state, a negative pressure state occurs on a center side (inner diameter side) of a rotor, cavitation thereby occurs, and a decrease in power of the atomization device caused by occurrence of cavitation is observed. Therefore, it is expected that a decrease in power will be observed similarly to the conventional device even by using the atomization device of the present embodiment.

However, contrary to such expectation, even in a case where processing such as emulsification, dispersion, dissolution, atomization, mixing, or stirring is continuously performed for a long time on a processing object with fluidity using the atomization device of the present embodiment while an inside of a processing tank is maintained in a vacuum state, a decrease in power caused by occurrence of cavitation is not observed.

As described above, in the atomization device of the present embodiment, as compared with a conventional atomization device including a conventional rotor-stator type mixer, processing ability to reduce a droplet diameter, that is, processing ability such as emulsification, dispersion, dissolution, atomization, mixing, or stirring can be effectively improved. Furthermore, even in a case where processing such as emulsification, dispersion, dissolution, atomization, mixing, or stirring is continuously performed for a long time on a processing object with fluidity while an inside of a processing tank is maintained in a vacuum state, a problem such as a decrease in power caused by occurrence of cavitation or breakage of a stator can be solved.

The atomization device of the present embodiment has a specific mechanism in which a rotating rotor makes a processing object flow at a predetermined pressure or higher. At this time, in the atomization device of the present embodiment, the power number: Np [−] of the above formula 1 is preferably 1.2 to 2 times, more preferably 1.2 to 1.9 times, still more preferably 1.2 to 1.8 times, still more preferably 1.2 to 1.7 times, still more preferably 1.2 to 1.6 times, still more preferably 1.2 to 1.5 times, and still more preferably 1.3 to 1.5 times that of a conventional atomization device including a conventional rotor-stator type mixer, not having a mechanism in which a rotating rotor makes a processing object flow at a predetermined pressure or higher.

In the atomization device of the present embodiment, a case where the power number: Np [−] is 1.2 times or more that of the conventional atomization device is preferable because processing ability to reduce a droplet diameter, that is, processing ability such as emulsification, dispersion, dissolution, atomization, mixing, or stirring can be effectively improved. Furthermore, in the atomization device of the present embodiment, a case where the power number: Np [−] is 2 times or less that of the conventional atomization device is preferable because processing ability to reduce a droplet diameter, that is, processing ability such as emulsification, dispersion, dissolution, atomization, mixing, or stirring can be effectively improved, and a decrease in power caused by occurrence of cavitation is not observed even in a case where processing such as emulsification, dispersion, dissolution, atomization, mixing, or stirring is continuously performed for a long time on a processing object with fluidity while an inside of a processing tank is maintained in a pressured state, at atmospheric pressure, or in a vacuum state.

In the atomization device of the present embodiment, when droplet diameters of an oil-in-water type emulsion (milk drink, liquid food, enteral nutrient, or the like) are compared between before and after processing such as emulsification, dispersion, dissolution, atomization, mixing, or stirring is performed on a processing object with fluidity, in a case where the droplet diameter of a fat (average fat globule diameter) before the processing is performed is, for example, 5 to 100 μm, the average fat globule diameter after the processing is performed is preferably 0.1 to 3 μm, more preferably 0.1 to 2 μm, still more preferably 0.2 to 1 μm, still more preferably 0.2 to 0.9 μm, still more preferably 0.3 to 0.8 μm, and still more preferably 0.3 to 0.7 μm.

At this time, the average fat globule diameter before the processing is performed is preferably 5 to 100 μm, more preferably 5 to 50 μm, still more preferably 5 to 25 μm, and still more preferably 10 to 20 μm.

At this time, in the atomization device of the present embodiment, a case where the average fat globule diameter before the processing is performed is 5 μm or more is preferable because a substantial effect of processing such as emulsification, dispersion, dissolution, atomization, mixing, or stirring can be obtained (exerted). Furthermore, in the atomization device of the present embodiment, a case where the average fat globule diameter before the processing is performed is 100 μm or less is preferable because a sufficient effect of the processing can be obtained.

In the atomization device of the present embodiment, processing time of a processing object is not particularly limited, but may be long or short.

For example, in a case where a liquid raw material of lipid (cream, compound cream, edible oils and fats, and the like) and/or a powder raw material of protein (milk protein, whey protein, isolated soy protein, and the like) are/is dispersed and/or dissolved in water, processing time of the processing object is preferably 10 to 180 minutes, more preferably 10 to 120 minutes, still more preferably 10 to 80 minutes, still more preferably 10 to 60 minutes, still more preferably 10 to 40 minutes, and still more preferably 10 to 20 minutes.

At this time, in a case where the liquid raw material of lipid and/or the powder raw material of protein are/is dispersed and/or dissolved in water, if the processing time of the processing object is the same, in the atomization device of the present embodiment, the processing amount (processing ability) of the processing object is two times that of a conventional atomization device including a conventional rotor-stator type mixer.

That is, in a case where the liquid raw material of lipid and/or the powder raw material of protein are/is dispersed and/or dissolved in water, if the processing amount of the processing object is the same, in the atomization device of the present embodiment, the processing time of the processing object is a half of that of a conventional atomization device including a conventional rotor-stator type mixer.

In the atomization device of the present embodiment, the processing temperature of a processing object is not particularly limited as long as the processing object has fluidity and has a temperature equal to or higher than a freezing point.

For example, in a case where a main component of a processing object is water, the freezing point of water is 0° C. Therefore, the processing temperature of the processing object is preferably 0 to 150° C., more preferably 3 to 140° C., still more preferably 5 to 130° C., still more preferably 5 to 120° C., still more preferably 5 to 110° C., still more preferably 5 to 100° C., still more preferably 5 to 80° C., and still more preferably 5 to 60° C.

At this time, in the atomization device of the present embodiment, if an inside of a processing tank is maintained in a pressured state, it is possible to operate the atomization device while the processing temperature of the processing object is set to 100° C. or higher.

Furthermore, in the atomization device of the present embodiment, if an inside of a processing tank is maintained at atmospheric pressure or in a vacuum state, it is possible to operate the atomization device while the processing temperature of the processing object is set to less than 100° C.

Note that, in the atomization device of the present embodiment, even in a case where the main component of the processing object is other than water (oils and fats, organic solvent, or the like), it is possible to operate the atomization device while the processing temperature of the processing object is set according to a similar concept to that in the case where the main component of the processing object is water.

In the atomization device of the present embodiment, the viscosity of a processing object is not particularly limited as long as having fluidity, but is preferably 0.1 to 50000 mPa·s, more preferably 0.2 to 25000 mPa·s, still more preferably 0.3 to 10000 mPa·s, still more preferably 0.5 to 5000 mPa·s, and still more preferably 1 to 5000 mPa·s.

At this time, in the atomization device of the present embodiment, a case where the viscosity of a processing object is 0.1 mPa·s or more is preferable because a substantial effect of processing such as emulsification, dispersion, dissolution, atomization, mixing, or stirring can be obtained. Furthermore, in the atomization device of the present embodiment, a case where the viscosity of a processing object is 50000 mPa·s or less is preferable because a sufficient effect of the processing can be obtained.

In the atomization device of the present embodiment, the solid content concentration of a processing object is not particularly limited as long as the processing object has fluidity, for example, the processing object has a concentration at a saturation concentration or less. However, the solid content concentration is preferably 0.1 to 90% by weight, more preferably 0.5 to 80% by weight, still more preferably 1 to 70% by weight, still more preferably 5 to 65% by weight, still more preferably 7 to 60% by weight, still more preferably 10 to 55% by weight, still more preferably 12 to 50% by weight, and still more preferably 15 to 45% by weight.

At this time, in the atomization device of the present embodiment, a case where the solid content concentration of a processing object is 0.1% by weight or more is preferable because a substantial effect of processing such as emulsification, dispersion, dissolution, atomization, mixing, or stirring can be obtained. Furthermore, in the atomization device of the present embodiment, a case where the solid content concentration of a processing object is 90% by weight or less is preferable because a sufficient effect of the processing can be obtained.

In the atomization device of the present embodiment, the speed at a tip of a stirring blade is an influential factor of the shearing frequency $f_{s,h}$ of the above formula 1, and is not particularly limited as long as a decrease in power caused by occurrence of cavitation is not observed even in a case where processing such as emulsification, dispersion, dissolution, atomization, mixing, or stirring is continuously performed for a long time on a processing object with fluidity while an inside of a processing tank is maintained in a pressured state, at atmospheric pressure, or in a vacuum state.

Note that the speed at a tip of a stirring blade: U [m/s] is defined as follows.

$U=\pi*N*D$ (π: circle ratio, N: rotation number, D: diameter of mixer)

Generally, in a conventional atomization device including a conventional rotor-stator type mixer, when the speed at a tip of a stirring blade is set to 20 m/s or more in order to improve processing ability such as emulsification, dispersion, dissolution, atomization, mixing, or stirring while an inside of a processing tank is maintained in a vacuum state, a decrease in power caused by occurrence of cavitation is observed.

However, meanwhile, in the atomization device of the present embodiment, even when the speed at a tip of a stirring blade is set to 20 m/s or more in order to improve processing ability such as emulsification, dispersion, dissolution, atomization, mixing, or stirring while an inside of a processing tank is maintained in a vacuum state, occurrence of cavitation is suppressed or prevented, and a decrease in power is not observed.

In the atomization device of the present embodiment, the speed at a tip of a stirring blade is preferably 1 to 100 m/s, more preferably 2 to 80 m/s, still more preferably 5 to 70 m/s, still more preferably 7 to 60 m/s, and still more preferably 10 to 50 m/s.

Another embodiment of the present invention is a method for manufacturing a product with fluidity, including performing any one or more of emulsification processing, dispersion processing, dissolution processing, atomization processing, mixing processing, and stirring processing on a processing object with fluidity using the atomization device of the present embodiment.

In the present embodiment, the product with fluidity means products of all fluids such as a liquid or a gel which is not solid. This product corresponds to all products obtained by processing a processing object with fluidity (raw material or the like) commercially (industrially). Specifically, this product corresponds to a food and drink with fluidity, a medicinal product with fluidity, a chemical product with fluidity (including a cosmetic product), and the like.

The food and drink with fluidity in the present embodiment means all foods and drinks with fluidity other than those approved as a medicinal product, including those capable of oral ingestion (administration) or tubal ingestion (administration) (intranasal ingestion or gastric fistula).

Example of the food and drink with fluidity in the present embodiment include soft drink (tea-based drink, coffee drink, cocoa drink, and the like), milk drink, lactic acid bacteria drink, fermented milk, condensed milk, cream, compound cream, edible fats and oils (vegetable oils and fats, modified fats and oils, and the like), extracts, soup stock, seasoning (soy sauce, sauce, soup, mayonnaise, ketchup, dressing, soy bean paste, and the like), roux for curry, stew, and the like, an instant food soup, a nutritional food (a liquid food or a nursing food (such as a thickened food), modified milk powder, health drink, and the like), butter, margarine, spread, and oily confectionery (chocolate and the like). Note that the food and drink with fluidity in the present embodiment also includes an intermediate product thereof, a semi-finished product thereof, and a final product thereof.

Here, the intermediate product or the semi-finished product is a product requiring processing afterwards, including a product to be subjected to powderization by drying processing, solidification by addition of a shape-retaining agent, imparting viscosity by addition of a thickener, a gelling agent, or the like, changing properties by mixing with other components, or the like.

Note that, in the present embodiment, among foods and drinks with fluidity, in a food or drink that needs to contain a high concentration of blending components (nutritional components) due to characteristics thereof, the blending time is effectively shortened, for example.

That is, the present embodiment is preferably applied to condensed milk, a liquid food of a nutritional food, a nursing food, modified milk powder, seasoning dressing, soy bean paste, roux for curry, stew, and the like, and an instant food soup.

In addition, example of the food and drink with fluidity in the present embodiment include a product obtained by atomizing (pulverizing or the like) a solid raw material, then putting the solid raw material into the atomization device of the present embodiment, and performing extraction under management or control (retention) at a predetermined temperature while the solid raw material is dispersed/mixed in a liquid raw material with fluidity. Example of the food and drink with fluidity in the present embodiment further include extracts and soup stock obtained by putting a solid raw material into the atomization device of the present embodiment, then atomizing the solid raw material, and performing extraction under management or control at a predetermined temperature while the solid raw material is dispersed/mixed in a liquid raw material with fluidity.

Here, specific examples of the solid raw material include tea leaves (green tea, oolong tea, black tea, and the like), powdered green tea, coffee, cacao, herb, truffle, shiitake mushroom, matsutake mushroom, meat (pork, beef, chicken, and the like), fishery products, seaweeds, fruits, and vegetables.

Specific examples of the liquid raw material include water (including cold water, warm water, and hot water), milk (including raw milk), milk drink (fluid containing milk component), skimmed milk, reduced skimmed milk, soymilk, fruit juice, and vegetable juice.

In the present embodiment, for example, it is preferable to efficiently obtain tea extracts, powdered green tea extracts, and coffee extracts by atomizing one or more of tea leaves, powdered green tea, and coffee, then putting one or more of tea leaves, powdered green tea, and coffee into the atomization device of the present embodiment, and performing extraction under retention at a predetermined temperature while one or more of tea leaves, powdered green tea, and coffee are dispersed/mixed in one or more of water, milk, and milk drink. Furthermore, it is preferable to efficiently obtain tea extracts, powdered green tea extracts, and coffee extracts by putting one or more of tea leaves, powdered green tea, and coffee into the atomization device of the present embodiment, then atomizing one or more of tea leaves, powdered green tea, and coffee, and performing extraction under retention at a predetermined temperature while one or more of tea leaves, powdered green tea, and coffee are dispersed/mixed in one or more of water, milk, and milk drink.

Example of the food and drink with fluidity in the present embodiment further include an oil-in-water type emulsion and a water-in-oil type emulsion obtained by putting an oil phase (oils and fats raw material) into the atomization device of the present embodiment, and performing (atomization/) emulsification under management or control (retention) at a predetermined temperature while the oil phase is dispersed/mixed in an aqueous phase with fluidity (water, water containing a powder raw material, a flavor component, or spices, a liquid raw material, or the like), or by putting an aqueous phase into the atomization device of the present embodiment, and performing (atomization/) emulsification under management or control (retention) at a predetermined temperature while the aqueous phase is dispersed/mixed in an oil phase with fluidity.

Here, specific examples of the oil-in-water type emulsion include milk drink, condensed milk, cream, compound cream, mayonnaise, dressing, a liquid food, and modified milk powder.

Examples of the water-in-oil type emulsion include butter, margarine, spread, and oily confectionery (chocolate).

In the present embodiment, it is preferable to efficiently obtain milk drink, mayonnaise, dressing, a liquid food, modified milk powder, spread, and oily confectionery by putting one or more of vegetable oils and fats, modified fats and oils, cream, and butter into the atomization device of the present embodiment, and performing (atomization/) emulsification under management or control (retention) at a predetermined temperature while one or more of vegetable oils and fats, modified fats and oils, cream, and butter are dispersed/mixed in one or more of water, water containing a powder raw material, a flavor component, or spices, and a liquid raw material, or by putting one or more of water, water containing a powder raw material, a flavor component, or spices, and a liquid raw material into the atomization device of the present embodiment, and performing (atomization/) emulsification under management or control at a predetermined temperature while one or more of water, water containing a powder raw material, a flavor component, or spices, and a liquid raw material are dispersed/mixed in one or more of vegetable oils and fats, modified fats and oils, cream, and butter.

In the food and drink with fluidity in the present embodiment, the content (concentration) of nutritional components (content of lipid, content of protein, content of saccharide (carbohydrate or the like), content of mineral, and content of vitamin) is not particularly limited as long as a processing object has fluidity. The content of nutritional components can be determined within a range where processing such as emulsification, dispersion, dissolution, atomization, mixing, or stirring can be performed using the atomization device of the present embodiment in accordance with a design of a product with fluidity.

In the food and drink with fluidity in the present embodiment, for example, in a case of a nutritional food (liquid food) of an oil-in-water type emulsion, the content of lipid is preferably 0 to 50% by weight, more preferably 0 to 40% by weight, still more preferably 0 to 30% by weight, and still more preferably 0 to 20% by weight, and the content of protein is preferably 0 to 50% by weight, more preferably 0 to 40% by weight, still more preferably 0 to 30% by weight, and still more preferably 0 to 20% by weigh. The content of saccharide is preferably 0 to 50% by weight, more preferably 0 to 40% by weight, still more preferably 0 to 30% by weight, and still more preferably 0 to 20% by weight. The content of nutritional components can be determined such that the total content of lipid, protein, saccharide, mineral, and vitamin is 100% by weight.

The medicinal product with fluidity in the present embodiment means all medicinal products with fluidity, approved as a medicinal product, including those capable of oral ingestion (administration) or tubal ingestion (administration) (intranasal ingestion or gastric fistula).

Specific examples of the medicinal product with fluidity in the present embodiment include those capable of oral ingestion or tubal ingestion (enteral nutrient or the like), those which can be applied or sprayed on the skin, nails, hair, or the like, eye drops (eye lotion or the like), and infusion (transfusion or the like). Note that the medicinal product with fluidity in the present embodiment also includes an intermediate product thereof, a semi-finished product thereof, and a final product thereof.

Here, the intermediate product or the semi-finished product is a product requiring processing afterwards, including a product to be subjected to powderization by drying processing, solidification by addition of a shape-retaining agent, imparting viscosity by addition of a thickener, a gelling agent, or the like, changing properties by mixing with other components, or the like.

The chemical product with fluidity in the present embodiment is a product not corresponding to the above food and drink or medicinal product, and means a cosmetic product, a chemical industrial product, or the like.

Specific examples of the chemical product with fluidity in the present embodiment include a cosmetic product, an industrial chemical, a chemical fertilizer, paper, pulp, rubber, a synthetic fiber, a synthetic resin, a dye, a detergent, an adhesive, a plaster, and a wax. Note that the chemical product with fluidity in the present embodiment also includes an intermediate product thereof, a semi-finished product thereof, and a final product thereof.

Here, the intermediate product or the semi-finished product is a product requiring processing afterwards, including a product to be subjected to powderization by drying processing, solidification by addition of a shape-retaining agent, imparting viscosity by addition of a thickener, a gelling agent, or the like, changing properties by mixing with other components, or the like.

The cosmetic product with fluidity in the present embodiment is a product applied or sprayed on the skin, nails, hair, or the like, in order to make the body clean, make an appearance beautiful, or the like, and performs a relaxing action.

Specific examples of the cosmetic product with fluidity in the present embodiment include a basic cosmetic product, a makeup cosmetic product, a perfume, a sunscreen cream, a shampoo, a rinse, and a conditioner. The cosmetic product with fluidity in the present embodiment is not only a general cosmetic product but also a medicated cosmetic product containing a medicinal component approved in Japan. Note that the cosmetic product with fluidity in the present embodiment also includes an intermediate product thereof, a semi-finished product thereof, and a final product thereof.

Specific examples of the cosmetic product with fluidity in the present embodiment include a cosmetic product containing a medicinal component for preventing or treating rough skin, acne, or the like, and a cosmetic product containing a medicinal component for preventing or treating body odor or halitosis (deodorant preparation, oral care preparation, or the like). Note that the cosmetic product with fluidity in the present embodiment also includes an intermediate product thereof, a semi-finished product thereof, and a final product thereof.

Here, the intermediate product or the semi-finished product is a product requiring processing afterwards, including a product to be subjected to powderization by drying processing, solidification by addition of a shape-retaining agent, imparting viscosity by addition of a thickener, a gelling agent, or the like, changing properties by mixing with other components, or the like.

The method for manufacturing a product with fluidity according to the present embodiment can reduce emulsification processing time, dispersion processing time, dissolution processing time, atomization processing time, mixing processing time, and stirring processing time, can increase an emulsification processing amount, a dispersion processing amount, a dissolution processing amount, an atomization processing amount, a mixing processing amount, and a stirring processing amount, and can improve an emulsification property, a dispersion property, a dissolution property, an atomization property, a mixing property, and a stirring property as compared with a case of performing any one or more of emulsification processing, dispersion processing, dissolution processing, atomization processing, mixing processing, and stirring processing on a processing object with fluidity using a conventional atomization device including a conventional rotor-stator type mixer.

Another embodiment of the present invention is a method for reducing any one or more of emulsification processing time, dispersion processing time, dissolution processing time, atomization processing time, mixing processing time, and stirring processing time when any one or more of emulsification processing, dispersion processing, dissolution processing, atomization processing, mixing processing, and stirring processing is performed on a processing object with fluidity using the atomization device of the present embodiment.

Another embodiment of the present invention is a method for increasing any one or more of an emulsification processing amount, a dispersion processing amount, a dissolution processing amount, an atomization processing amount, a mixing processing amount, and a stirring processing amount when any one or more of emulsification processing, dispersion processing, dissolution processing, atomization processing, mixing processing, and stirring processing is performed on a processing object with fluidity using the atomization device of the present embodiment.

Another embodiment of the present invention is a method for improving any one or more of an emulsification property, a dispersion property, a dissolution property, an atomization property, a mixing property, and a stirring property when any one or more of emulsification processing, dispersion processing, dissolution processing, atomization processing, mixing processing, and stirring processing is performed on a processing object with fluidity using the atomization device of the present embodiment.

Another embodiment of the present invention is use of an atomization device for reducing any one or more of emulsification processing time, dispersion processing time, dissolution processing time, atomization processing time, mixing processing time, and stirring processing time in manufacturing a product with fluidity, including performing any one or more of emulsification processing, dispersion processing, dissolution processing, atomization processing, mixing processing, and stirring processing on a processing object with fluidity using the atomization device of the present embodiment.

Another embodiment of the present invention is use of an atomization device for increasing any one or more of an emulsification processing amount, a dispersion processing amount, a dissolution processing amount, an atomization processing amount, a mixing processing amount, and a stirring processing amount in manufacturing a product with fluidity, including performing any one or more of emulsification processing, dispersion processing, dissolution processing, atomization processing, mixing processing, and stirring processing on a processing object with fluidity using the atomization device of the present embodiment.

Another embodiment of the present invention is use of an atomization device for improving any one or more of an emulsification property, a dispersion property, a dissolution property, an atomization property, a mixing property, and a stirring property in manufacturing a product with fluidity, including performing any one or more of emulsification processing, dispersion processing, dissolution processing, atomization processing, mixing processing, and stirring processing on a processing object with fluidity using the atomization device of the present embodiment.

Another embodiment of the present invention is a method for designing the atomization device of the present embodiment, including designing a structure of a rotor-stator type mixer disposed in the atomization device such that a predetermined droplet diameter of a processing object can be obtained in a predetermined operation time by calculating a droplet diameter of the processing object obtained by calculation with operation time of the mixer using the above formula 1 when any one or more of emulsification processing, dispersion processing, dissolution processing, atomization processing, mixing processing, and stirring processing is performed on the processing object using the mixer.

Another embodiment of the present invention is a method for evaluating performance of the atomization device of the present embodiment, including evaluating performance of the atomization device in any one or more of emulsification processing, dispersion processing, dissolution processing, atomization processing, mixing processing, and stirring processing on a processing object by determining the total energy dissipation ratio: $\varepsilon_t$ using the above formula 1 and evaluating the magnitude of a value of a shape dependent term in a stator which is a numerical value specific to each mixer obtained by measuring the size of a rotor-stator and power/flow rate during operation included in the above formula 1.

Another embodiment of the present invention is a method for scaling up or scaling down the atomization device of the present embodiment by correspondence to scaling up or scaling down a rotor-stator type mixer disposed in the atomization device, including matching a value of the total energy dissipation ratio: $\varepsilon_t$ of the mixer in an experimental scale or in a pilot plant scale, obtained by above formula 1 with a calculation value of the total energy dissipation ratio: $\varepsilon_t$ of an actual manufacturing machine of the mixer to be scaled up or scaled down.

In any of the embodiments described above, as a mechanism in which a rotating rotor included in the atomization device of each of the embodiments makes a processing object flow at a predetermined pressure or higher, it is possible to adopt a mechanism in which a rotating rotor makes a processing object flow in a direction orthogonal to a rotational direction of the rotor inside the rotor in a radial direction.

As such a mechanism, it is possible to adopt a mechanism in which, in a rotating rotor, the rotating rotor makes a processing object flow at a predetermined pressure or higher by disposing an additional rotor in the vicinity of an outer periphery of a rotating shaft for rotating the rotor disposed inside the rotor in a radial direction and rotating the additional rotor.

In addition, as such a mechanism, it is possible to adopt a mechanism in which, in a rotating rotor, the rotating rotor makes a processing object flow at a predetermined pressure or higher by disposing a draft tube in the vicinity of an outer periphery of a rotating shaft for rotating the rotor disposed inside the rotor in a radial direction.

Furthermore, as such a mechanism, it is possible to adopt a mechanism in which a draft tube is used in combination with the above additional rotor (second rotor).

Hereinafter, the present invention will be described in detail by way of Examples, but the present invention is not limited to these Examples.

EXAMPLES

Example 1

An atomization device including a rotor-stator type mixer having a mechanism in which a rotating rotor makes a processing object flow at a predetermined pressure or higher, having the structure illustrated in FIG. 6, was prepared in a processing tank (capacity: 100 L). An effect of suppressing a decrease in power in a vacuum state was verified using this atomization device.

Figure 7A:
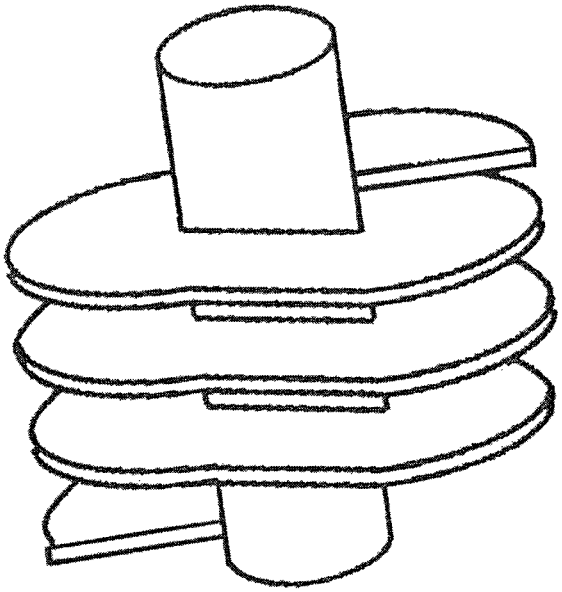
FIG. 7 is a conceptual diagram for explaining an additional rotor (second rotor).
Figure 7B:
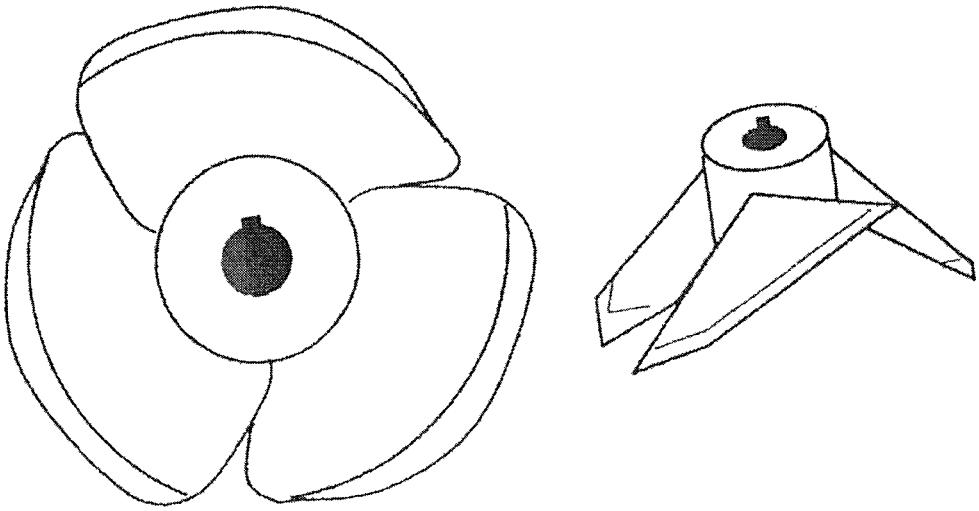

Note that, as a mechanism in which a rotating rotor makes a processing object flow at a predetermined pressure or higher, using the additional rotor (second rotor) illustrated in FIG. 3, the second rotor having a screw type shape/structure illustrated in FIG. 7(*a*) was used.

Figure 8:
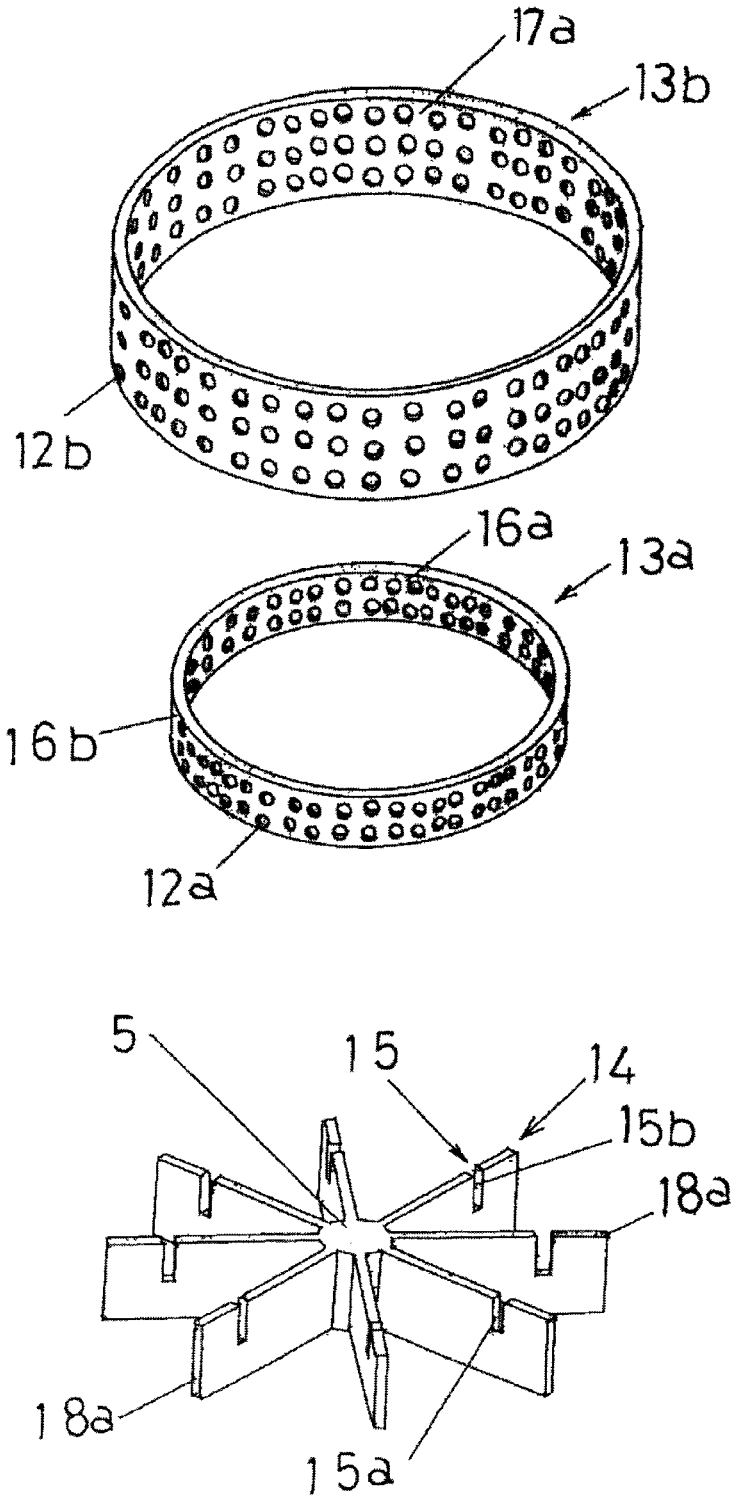
FIG. 8 is an exploded perspective view for explaining a schematic configuration of a mixer in an atomization device in Example 1.

As a stator, the two stages illustrated in the reference signs 13*a* and 13*b* of FIG. 8 were used using the shape/structure with a punching metal-like hole: Φ 3 mm opened, illustrated in the reference signs 12*a* and 12*b* of FIG. 8.

As a rotor, the eight stirring blades illustrated in the reference sign 14 of FIG. 8, having a shape/structure of (length (diameter) of stirring blade: 200 mm, height of stirring blade: 30 mm) were used. Here, each of the stirring blades has a groove 15. A small diameter stator 13*a* is housed in the groove 15. A peripheral surface 15*a* directed outward in a radial direction of the groove 15 is opposed to an inner peripheral surface 16*a* of the stator 13*a*. A peripheral surface 15*b* directed inward in the radial direction of the groove 15 is opposed to an outer peripheral surface 16*b* of the stator 13*a*. An outer peripheral surface 18*a* of each of the stirring blades of the rotor 14 is opposed to an inner peripheral surface 17*a* of the large-diameter stator 13*b*.

A change in power was measured while the rotation number of the stirring blades of the rotor 14 was increased. Specifically, the reduction amount of power was measured when the vacuum pressure was set to −0.05 MPa, and a reduction ratio of the power was calculated based on original power.

Meanwhile, for comparison, an atomization device including a rotor-stator type mixer having the same structure except that the second rotor was not included was similarly examined under the same conditions.

Figure 9:
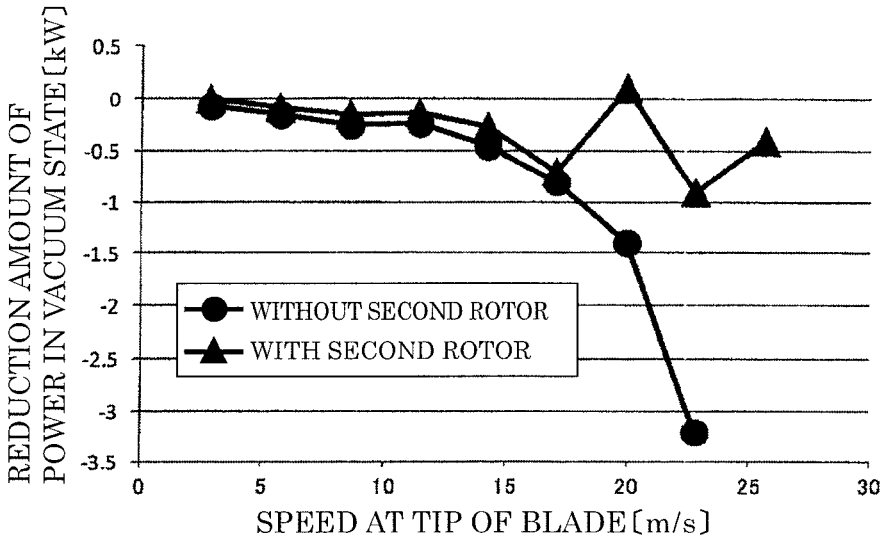
FIG. 9 is a graph indicating the reduction amount of power in a vacuum state in the atomization device in Example 1.

FIG. 9 illustrates a relationship between a speed at a tip of a stirring blade of a mixer and the reduction amount of power in a vacuum state.

As illustrated in FIG. 9, it was confirmed that a decrease in power in a vacuum state could be suppressed by using the second rotor. Regarding this fact, in a range where the speed at a tip of a stirring blade exceeded 20 m/s, a particularly remarkable effect of suppressing a decrease in power was indicated.

The effect of suppressing a decrease in power in a vacuum state was examined by replacing the second rotor having a screw type shape/structure illustrated in FIG. 7(*a*) with the second rotor having a propeller type shape/structure illustrated in FIG. 7(*b*). The left side of FIG. 7(*b*) is a view seen from a lower side of the propeller type second rotor. The right side of FIG. 7(*b*) is a view seen from an obliquely upper side of the propeller type second rotor. Three stirring blades are attached to an outer periphery of a rotating shaft which is a rotation center of the rotor with a gap corresponding to 120° in a circumferential direction.

Even when the second rotor having a propeller type shape/structure illustrated in FIG. 7(*b*) was used, it was confirmed that a decrease in power in a vacuum state could be suppressed in a similar manner to the above. In addition, in a range where the speed at a tip of a stirring blade exceeded 20 m/s, a particularly remarkable effect of suppressing a decrease in power was indicated.

Note that, when the second rotor having either shape/structure of FIGS. 7(*a*) and 7(*b*) was used, the power number: $N_p$ [−] was 1.52, and an atomization device not including a second rotor had a power number: $N_p$ [−] of 1.16.

That is, in the atomization device including the second rotor illustrated in FIG. 7(*a*) or 7(*b*), the power number: $N_p$ [−] was 1.3 times that of an atomization device not including the second rotor illustrated in FIG. 7(*a*) or 7(*b*).

Incidentally, when a case of using the second rotor having the shape/structure illustrated in each of FIGS. 7(*a*) and 7(*b*) was examined, it was confirmed that the second rotor having the propeller type shape/structure illustrated in FIG. 7(*b*) had a shape/structure capable of suppressing a pressure drop (negative pressure) more than the second rotor having the screw type shape/structure illustrated in FIG. 7(*a*).

In the atomization device of the present embodiment, the shape/structure of the second rotor is not particularly limited as long as being able to exert a force to make a processing fluid flow so as to push the processing fluid toward the rotor 3 and the stator 2. However, the shape/structure is preferably a screw type or a propeller type from a viewpoint of being able to strongly exert a force to make the processing fluid flow so as to push the processing fluid. According to a comparison between the two, the propeller type is more preferable.

Example 2

An atomization device including a rotor-stator type mixer having a mechanism in which a rotating rotor makes a processing object flow at a predetermined pressure or higher, having the structure illustrated in FIG. 6, was prepared in a processing tank (capacity: 7000 L). An effect of suppressing a decrease in power in a vacuum state was verified using this atomization device.

Note that, as a mechanism in which a rotating rotor makes a processing object flow at a predetermined pressure or higher, the additional rotor (second rotor) illustrated in FIG. 3 was used. As the second rotor, a rotor having a shape/structure with a protruding curved stirring blade inclined upwardly, illustrated in FIG. 10, was used. Three stirring blades are attached to an outer periphery of a rotating shaft which is a rotation center of the rotor with a gap corresponding to 120° in a circumferential direction.

Figure 10:
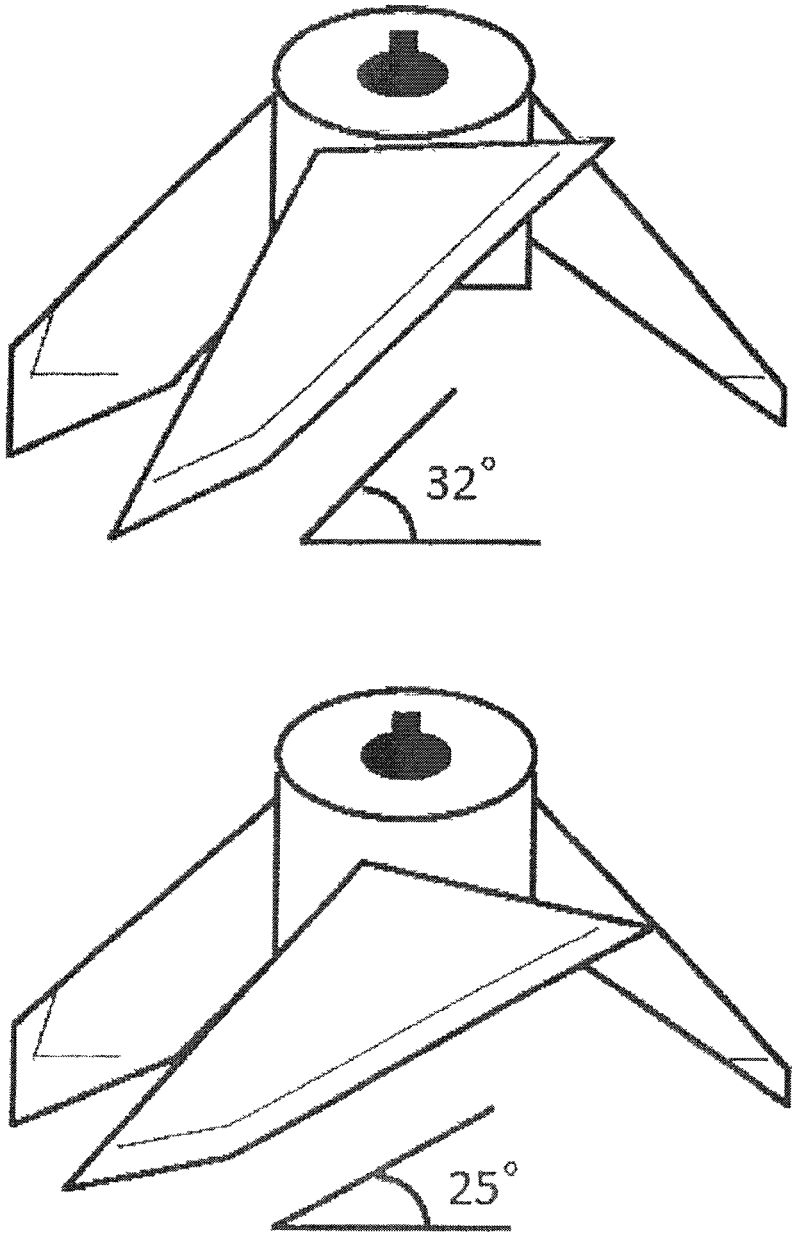
FIG. 10 is a conceptual diagram for explaining an additional rotor in an atomization device in Example 2. The rotor has a stirring blade inclined at 32 degrees or 25 degrees with respect to a plane orthogonal to a direction of a rotating shaft.

Note that, specifically, as the second rotor, rotors having two different shapes/structures with the inclinations of the stirring blade of 32° and 25°, illustrated in FIG. 10, were used.

As a stator, the two stages illustrated in the reference signs 13*a* and 13*b* of FIG. 8 were used using the shape/structure with a punching metal-like hole: Φ 3 mm opened, illustrated in the reference signs 12*a* and 12*b* of FIG. 8.

As a rotor, the eight stirring blades illustrated in the reference sign 14 of FIG. 8, having a shape/structure of (length (diameter) of stirring blade: 400 mm, height of stirring blade: 60 mm) were used. Here, each of the stirring blades has a groove 15. A small diameter stator 13*a* is housed in the groove 15. A peripheral surface 15*a* directed outward in a radial direction of the groove 15 is opposed to an inner peripheral surface 16*a* of the stator 13*a*. A peripheral surface 15*b* directed inward in the radial direction of the groove 15 is opposed to an outer peripheral surface 16*b* of the stator 13*a*. An outer peripheral surface 18*a* of each of the stirring blades of the rotor 14 is opposed to an inner peripheral surface 17*a* of the large-diameter stator 13*b*.

A change in power was measured while the rotation number of the stirring blades of the rotor 14 was increased. Specifically, the reduction amount of power was measured when the vacuum pressure was set to −0.07 MPa.

Meanwhile, for comparison, an atomization device including a rotor-stator type mixer having the same structure except that the second rotor was not included was similarly examined under the same conditions.

Figure 11:
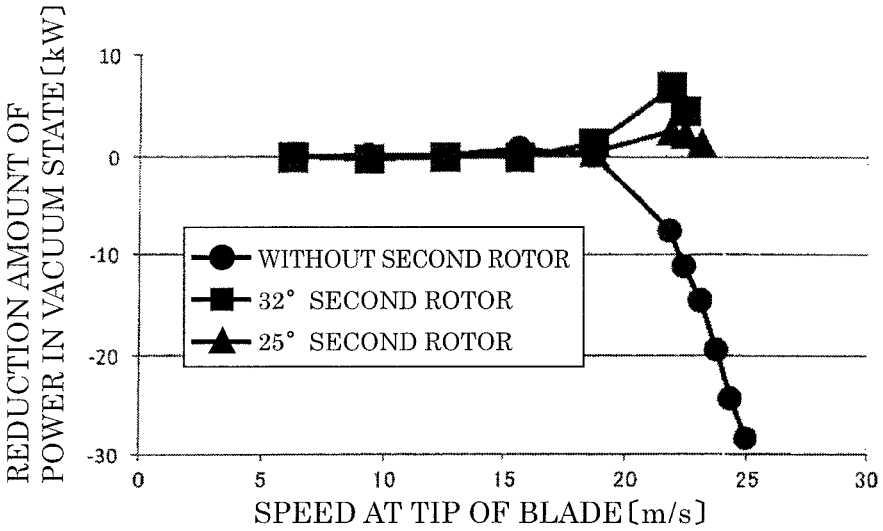
FIG. 11 is a graph indicating a relationship between a speed at a tip of a stirring blade of the additional rotor and the reduction amount of power in a vacuum state in the atomization device in Example 2.

FIG. 11 illustrates a relationship between a speed at a tip of a stirring blade of a mixer and the reduction amount of power in a vacuum state.

As illustrated in FIG. 11, it was confirmed that a decrease in power in a vacuum state could be suppressed by using the second rotor. Regarding this fact, in a similar manner to Example 1, in a range where the speed at a tip of a stirring blade exceeded 20 m/s, a particularly remarkable effect of suppressing a decrease in power was indicated.

In the second rotor with the inclination of the stirring blade of 32°, illustrated in FIG. 10, a more remarkable effect of suppressing a decrease in power was indicated than the second rotor with the inclination of the stirring blade of 25°, illustrated in FIG. 10.

Incidentally, in the atomization device including the second rotor with the inclination of the stirring blade of 32°, illustrated in FIG. 10, the power number: $N_p$ [−] was 1.67, and in the atomization device including the second rotor with the inclination of the stirring blade of 25°, illustrated in FIG. 10, the power number: $N_p$ [−] was 1.52.

In an atomization device not including the second rotor illustrated in FIG. 10, the power number: $N_p$ [−] was 1.16.

That is, in the atomization device including the second rotor with the inclination of the stirring blade of 32°, illustrated in FIG. 10, the power number: $N_p$ [−] was 1.4 times that of an atomization device not including the second rotor illustrated in FIG. 10. Furthermore, in the atomization device including the second rotor with the inclination of the stirring blade of 25°, illustrated in FIG. 10, the power number: $N_p$ [−] was 1.3 times that of an atomization device not including the second rotor illustrated in FIG. 10.

Example 3

An atomization device including a rotor-stator type mixer having a mechanism in which a rotating rotor makes a processing object flow at a predetermined pressure or higher, having the structure illustrated in FIG. 6, was prepared in a processing tank (capacity: 10000 L). An effect of suppressing a decrease in power in a vacuum state was verified using this atomization device.

Note that, as a mechanism in which a rotating rotor makes a processing object flow at a predetermined pressure or higher, the additional rotor (second rotor) illustrated in FIG. 3 and a draft tube were used. As the second rotor, rotors each having a shape/structure with a protruding curved stirring blade inclined upwardly, illustrated in FIG. 10, and having two different shapes/structures with the inclinations of the stirring blade of 32° and 25°, illustrated in FIG. 10, were used.

The draft tube for forcibly making a processing object flow in a direction substantially parallel to an axial direction of a rotating shaft in a rotor rotating around the rotating shaft, disposed in the vicinity of an outer periphery of the rotating shaft for rotating the rotor, was disposed on an upper side of the rotating shaft (side away from the rotor 14) than the position where the second rotor was disposed on the rotating shaft.

As a stator, the two stages illustrated in the reference signs 13*a* and 13*b* of FIG. 8 were used using the shape/structure with a punching metal-like hole: Φ 3 mm opened, illustrated in the reference signs 12*a* and 12*b* of FIG. 8.

As a rotor, the eight stirring blades illustrated in the reference sign 14 of FIG. 8, having a shape/structure of (length (diameter) of stirring blade: 400 mm, height of stirring blade: 60 mm) were used. Here, each of the stirring blades has a groove 15. A small diameter stator 13*a* is housed in the groove 15. A peripheral surface 15*a* directed outward in a radial direction of the groove 15 is opposed to an inner peripheral surface 16*a* of the stator 13*a*. A peripheral surface 15*b* directed inward in the radial direction of the groove 15 is opposed to an outer peripheral surface 16*b* of the stator 13*a*. An outer peripheral surface 18*a* of each of the stirring blades of the rotor 14 is opposed to an inner peripheral surface 17*a* of the large-diameter stator 13*b*.

A change in power was measured while the rotation number of the stirring blades of the rotor 14 was increased. Specifically, the reduction amount of power was measured when the vacuum pressure was set to −0.075 MPa.

Meanwhile, for comparison, an atomization device including a rotor-stator type mixer having the same structure except that neither the second rotor nor the draft tube was included or the second rotor was included but the draft tube was not included, was similarly examined under the same conditions.

Figure 12:
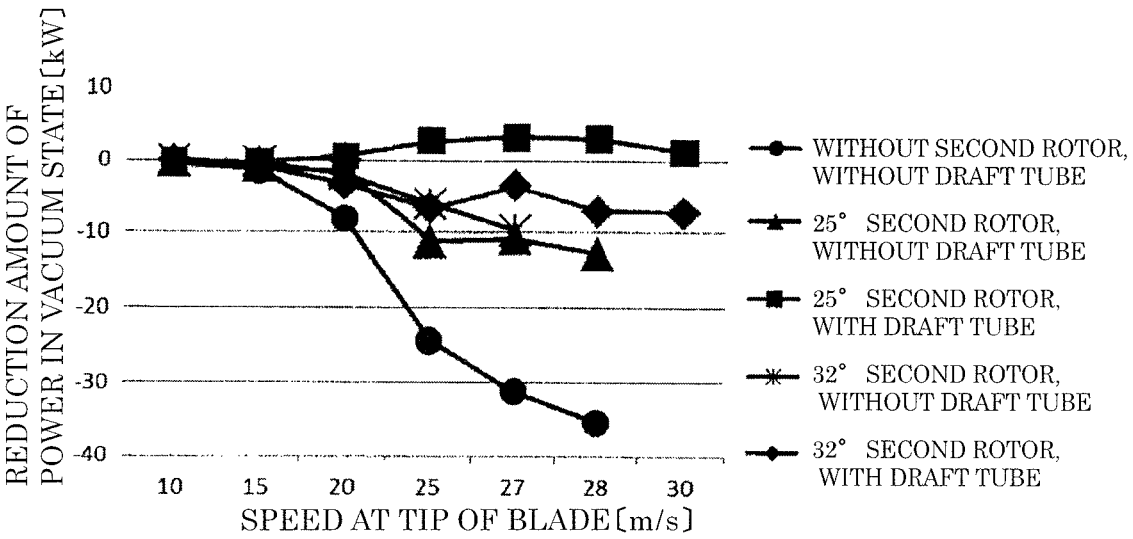
FIG. 12 is a graph indicating a relationship between a speed at a tip of a stirring blade of an additional rotor and the reduction amount of power in a vacuum state in an atomization device in Example 3.

FIG. 12 illustrates a relationship between a speed at a tip of a stirring blade of a mixer and the reduction amount of power in a vacuum state.

As illustrated in FIG. 12, it was confirmed that a decrease in power in a vacuum state could be suppressed by using the second rotor and the draft tube. In addition, it was confirmed that a decrease in power in a vacuum state could be further suppressed by using the second rotor and the draft tube (using both thereof). Regarding this fact, in a similar manner to Example 1 or 2, in a range where the speed at a tip of a stirring blade exceeded 20 m/s, a particularly remarkable effect of suppressing a decrease in power was indicated.

Example 4

An atomization device including a rotor-stator type mixer having a mechanism in which a rotating rotor makes a processing object flow at a predetermined pressure or higher, having the structure illustrated in FIG. 6, was prepared in a processing tank (capacity: 20000 L). Using this atomization device, the dissolution property of isolated soy protein as a powder raw material was verified.

As a mechanism in which a rotating rotor makes a processing object flow at a predetermined pressure or higher, the additional rotor (second rotor) illustrated in FIG. 3 was used. As the second rotor, the rotor having a shape/structure with a protruding curved stirring blade inclined upwardly, illustrated in FIG. 10, and having a shape/structure with the inclination of the stirring blade of 32°, illustrated in FIG. 10, was used.

As a stator, the two stages illustrated in the reference signs 13*a* and 13*b* of FIG. 8 were used using the shape/structure with a punching metal-like hole: Φ 3 mm opened, illustrated in the reference signs 12*a* and 12*b* of FIG. 8.

As a rotor, the eight stirring blades illustrated in the reference sign 14 of FIG. 8, having a shape/structure of (length (diameter) of stirring blade: 400 mm, height of stirring blade: 60 mm) were used. Here, each of the stirring blades has a groove 15. A small diameter stator 13*a* is housed in the groove 15. A peripheral surface 15*a* directed outward in a radial direction of the groove 15 is opposed to an inner peripheral surface 16*a* of the stator 13*a*. A peripheral surface 15*b*, directed inward in the radial direction of the groove 15 is opposed to an outer peripheral surface 16*b* of the stator 13*a*. An outer peripheral surface 18*a* of each of the stirring blades of the rotor 14 is opposed to an inner peripheral surface 17*a* of the large-diameter stator 13*b*.

Note that, in the atomization device including the second rotor with the inclination of the stirring blade of 32°, illustrated in FIG. 10, the power number: $N_p$ [−] was 1.52.

Into this processing tank, 16000 L of raw material water was put. The temperature of the raw material water was adjusted to 55° C. Into the raw water material stirred by setting the rotation number of the rotor to 1100 rpm, 100 kg of isolated soy protein (SUPRO 1610) as a powder raw material was put. At this time, the vacuum pressure in the processing tank was −0.08 MPa. When 15 minutes passed after the isolated soy protein as a powder raw material was put in, 500 g of the processing fluid (aqueous solution) was collected, and was caused to pass through a filter (60 mesh). Thereafter, the weight of the residue was measured, and was 10 mg or less. It was confirmed that dissolution of the isolated soy protein as a powder raw material had been completely completed in only 15 minutes.

Comparative Example 1

Using a conventional atomization device having no mechanism in which a rotating rotor makes a processing object flow at a predetermined pressure or higher in a processing tank (capacity: 10000 L), a dissolution property of isolated soy protein as a powder raw material was verified.

As a conventional rotor-stator type mixer, a turbo mixer (Scanima Company: Turbo Mixer, including a rotor having a stirring blade length (diameter) of 400 mm and a stator having a slit width of 4 mm) was used.

Note that the turbo mixer of the conventional atomization device had a power number: $N_p$ [−] of 1.16.

Into this processing tank, 8000 L of raw material water was put. The temperature of the raw material water was adjusted to 55° C. Into the raw water material stirred by setting the rotation number of the rotor to 1260 rpm, 50 kg of isolated soy protein (SUPRO 1610) as a powder raw material was put. At this time, the vacuum pressure in the processing tank was −0.08 MPa. When 15 minutes passed after the isolated soy protein as a powder raw material was put in, 500 g of the processing fluid (aqueous solution) was collected, and was caused to pass through a filter (60 mesh). Thereafter, the weight of the residue was measured, and was 10 mg or more. It was confirmed that dissolution of the isolated soy protein as a powder raw material had been almost completed in only 15 minutes.

Here, in Example 4 (atomization device having the rotor-stator type mixer of the present invention disposed inside the processing tank), the weight of the powder raw material that could be dissolved in a predetermined time (15 minutes) was 100 kg. Meanwhile, in Comparative Example 1 (conventional rotor-stator type mixer), the weight of the powder raw material that could be dissolved in a predetermined time (15 minutes) was 50 kg.

That is, it has been indicated that Example 4 (atomization device having the rotor-stator type mixer of the present invention disposed inside the processing tank) has a better effect of dissolving the powder raw material than Comparative Example 1 (conventional rotor-stator type mixer).

This has revealed that by using an atomization device having a rotor-stator type mixer disposed in a processing tank, and performing any one or more processing of emulsification, dispersion, atomization, mixing, and stirring on a processing object with fluidity using the rotor-stator type mixer while an inside of the processing tank is maintained in a pressured state, at atmospheric pressure, or in a vacuum'state, the atomization device having a mechanism in which the rotating rotor makes the processing object flow at a predetermined pressure or higher, the processing can be performed efficiently.

REFERENCE SIGNS LIST

1 A plurality of openings
2 Stator
3 Rotor
4 Mixer unit
5 Rotating shaft
6 Second rotor
6*a*, 6*b*, 6*c* Additional rotor (second rotor)
8 Opening
7 Lid member
11 Processing tank

The invention claimed is:

1. An atomization device comprising, inside a processing tank, a rotor-stator type mixer including:

a stator having a plurality of openings in a peripheral wall thereof; and a rotor disposed inside the stator with a predetermined gap in a radial direction between the rotor and an inner peripheral surface of the stator, wherein the atomization device performs any one or more of emulsification processing, dispersion processing, dissolution processing, atomization processing, mixing processing, and stirring processing on a processing object with fluidity using the rotor-stator type mixer while an inside of the processing tank is maintained in a pressured state, at atmospheric pressure, or in a vacuum state, the atomization device has a mechanism in which the rotating rotor makes the processing object flow at a predetermined pressure or higher, the mechanism in which the rotating rotor makes the processing object flow at a predetermined pressure or higher is a mechanism in which, in the rotating rotor, the rotating rotor makes the processing object flow at a predetermined pressure or higher by disposing an additional rotor in the vicinity of an outer periphery of a rotating shaft of the rotor and rotating the additional rotor, and the additional rotor comprises a stirring blade, wherein the stirring blade is inclined at an angle with respect to a plane being orthogonal to a direction of the rotating shaft, wherein said angle is between 15 to 70°, a height of the stirring blade in an axial direction of the rotating shaft is at least 0.32 times as long as the diameter of the rotor.

2. The atomization device according to claim 1, wherein the mechanism in which the rotating rotor makes the processing object flow at a predetermined pressure or higher is a mechanism that makes the processing object flow in a direction orthogonal to a rotational direction of the rotor inside the rotor in a radial direction.

3. The atomization device according to claim 1, wherein the mechanism in which the rotating rotor makes the processing object flow at a predetermined pressure or higher is a mechanism in which, in the rotating rotor, the rotating rotor makes the processing object flow at a predetermined pressure or higher by further disposing a draft tube in the vicinity of an outer periphery of the rotating shaft of the rotor.

4. The atomization device according to claim 1, wherein the rotor-stator type mixer is a rotor-stator type mixer in which a portion in contact with the processing object in an outer side of the rotor in a radial direction is covered with a lid member.

5. A method for manufacturing a product with fluidity, comprising performing any one or more of emulsification processing, dispersion processing, dissolution processing, atomization processing, mixing processing, and stirring processing on a processing object with fluidity using the atomization device according to claim 1.

6. The method for manufacturing a product with fluidity according to claim 5, wherein the product with fluidity is a food or drink, a medicinal product, or a chemical product.

* * * * *